US008733048B1

(12) United States Patent
Hanson

(10) Patent No.: US 8,733,048 B1
(45) **Date of Patent: *May 27, 2014**

(54) MULTI-STORY DURABLE WALL CONSTRUCTION

(71) Applicant: Highland Technologies, LLC, Jupiter, FL (US)

(72) Inventor: William C. Hanson, Palm City, FL (US)

(73) Assignee: Highland Technologies, LLC, Jupiter, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/178,070

(22) Filed: Feb. 11, 2014

Related U.S. Application Data

(63) Continuation-in-part of application No. 14/137,347, filed on Dec. 20, 2013.

(51) Int. Cl.

| | |
|---|---|
| ***E04F 13/04*** | (2006.01) |
| ***E04B 9/00*** | (2006.01) |
| ***E04B 1/18*** | (2006.01) |
| ***E04B 1/16*** | (2006.01) |
| ***E04B 1/19*** | (2006.01) |
| ***E04B 1/24*** | (2006.01) |

(52) U.S. Cl.
CPC ... *E04B 1/18* (2013.01); *E04B 1/16* (2013.01); *E04B 1/19* (2013.01); *E04B 1/1903* (2013.01); *E04B 1/24* (2013.01); *E04B 1/2403* (2013.01)
USPC ..... 52/348

(58) Field of Classification Search
CPC ..... E04B 1/18; E04B 1/16; E04B 1/19; E04B 1/1903; E04B 1/24; E04B 1/2403
USPC ..... 52/741.13, 741.4, 741.41, 745.21, 348, 52/344, 350, 353, 363
See application file for complete search history.

(56) References Cited

U.S. PATENT DOCUMENTS

| | | | |
|---|---|---|---|
| 610,457 | A | 9/1898 | Omeis |
| 630,141 | A | 8/1899 | Venezia |
| 670,809 | A | 3/1901 | Perry |
| 706,348 | A | 8/1902 | Simpson et al. |
| 719,191 | A | 1/1903 | Collins |
| 799,544 | A | 9/1905 | Dennis |

(Continued)

FOREIGN PATENT DOCUMENTS

| | | |
|---|---|---|
| FR | 2562581 | 10/1985 |
| JP | 04276404 A | 10/1992 |
| WO | WO0159235 | 8/2001 |
| WO | WO2012115607 | 8/2012 |

*Primary Examiner* — Mark Wendell
*Assistant Examiner* — Keith Minter
(74) *Attorney, Agent, or Firm* — McHale & Slavin, P.A.

(57) ABSTRACT

A multi-story durable wall construction that is seamlessly integrated with a foundation and construction pad. The construction process incorporates stabilizing elements that rests a primary layer or sheet of welded-wire fabric on a foundation having rebar dowels protruding therefrom. Interlocking temporary upper guiderails are held in place by vertical rebar support rods. The temporary guiderails stabilize the top edge of the primary layer of welded-wire fabric, and rib lath is attached to the surface of the primary layer of welded-wire fabric to form a structural panel. Pressurized concrete is evenly applied to all of the inside and outside surfaces of the structural panels. Once the concrete has cured sufficiently, the upper stabilizing guide rails are removed to provide a durable wall.

18 Claims, 20 Drawing Sheets

(56) References Cited

U.S. PATENT DOCUMENTS

| | | | | |
|---|---|---|---|---|
| 1,258,409 | A | | 3/1918 | Hill |
| 1,498,182 | A | | 6/1924 | Lindsay |
| 1,530,662 | A | | 3/1925 | Gibbons et al. |
| 1,577,633 | A | | 3/1926 | Collins |
| 1,598,145 | A | | 8/1926 | Lozano |
| 1,779,713 | A | | 10/1930 | Satterlee |
| 1,815,075 | A | | 7/1931 | Sersen |
| 2,087,867 | A | | 7/1937 | Balduf |
| 2,104,869 | A | | 1/1938 | Levy |
| 2,104,873 | A | | 1/1938 | Levy |
| 2,104,875 | A | | 1/1938 | Levy |
| 2,134,155 | A | | 10/1938 | Spinosa |
| 2,184,353 | A | | 12/1939 | Leary |
| 2,208,191 | A | | 7/1940 | Kerr |
| 2,311,951 | A | | 2/1943 | Marshall |
| 2,369,000 | A | | 2/1945 | Page |
| 2,391,960 | A | | 1/1946 | Gede, Jr. |
| 2,540,305 | A | | 2/1951 | Tomlinson |
| 2,827,736 | A | | 3/1958 | Estey |
| 2,969,565 | A | | 1/1961 | Levy |
| 3,302,343 | A | | 2/1967 | Bear |
| 3,304,685 | A | | 2/1967 | Whetstone |
| 3,395,506 | A | | 8/1968 | Petrig |
| 3,578,732 | A | | 5/1971 | Lount et al. |
| 3,622,656 | A | | 11/1971 | Dewey, Jr. et al. |
| 3,676,973 | A | | 7/1972 | Kellert |
| 3,802,147 | A | | 4/1974 | O'Konski |
| 4,052,829 | A | | 10/1977 | Chapman |
| 4,253,288 | A | | 3/1981 | Chun |
| 4,327,529 | A | | 5/1982 | Bigelow, Jr. et al. |
| 4,443,992 | A | | 4/1984 | Shechter |
| 4,472,919 | A | * | 9/1984 | Nourse ..... 52/601 |
| 4,489,530 | A | | 12/1984 | Chang |
| 4,494,353 | A | | 1/1985 | Lewis |
| 4,559,752 | A | | 12/1985 | Kieffer |
| 4,688,358 | A | | 8/1987 | Madray |
| 4,918,899 | A | | 4/1990 | Karytinos |
| 4,987,719 | A | * | 1/1991 | Goodson, Jr. ..... 52/742.14 |
| 5,081,814 | A | | 1/1992 | Singletary et al. |
| 5,157,887 | A | | 10/1992 | Watterworth, III |
| 5,218,801 | A | | 6/1993 | Hereford |
| 5,335,472 | A | | 8/1994 | Phillips |
| 5,375,381 | A | | 12/1994 | Park et al. |
| 5,381,633 | A | | 1/1995 | Hendrich |
| 5,487,242 | A | | 1/1996 | Stafford |
| 5,611,183 | A | * | 3/1997 | Kim ..... 52/426 |
| 5,697,195 | A | | 12/1997 | Maylon |
| 5,740,643 | A | | 4/1998 | Huntley |
| 6,073,404 | A | | 6/2000 | Norfleet |
| 6,112,489 | A | * | 9/2000 | Zweig ..... 52/405.1 |
| 6,370,835 | B1 | | 4/2002 | Morgan et al. |
| 6,508,043 | B1 | | 1/2003 | Bond et al. |
| 6,907,698 | B1 | | 6/2005 | Bond |
| 8,006,451 | B2 | | 8/2011 | Bond |
| 8,365,489 | B1 | | 2/2013 | Bond |
| 2012/0304565 | A1 | * | 12/2012 | Hines et al. ..... 52/302.1 |
| 2013/0019542 | A1 | * | 1/2013 | Bishop ..... 52/79.11 |

* cited by examiner

MULTI-STORY DURABLE WALL CONSTRUCTION

PRIORITY CLAIM

In accordance with 37 C.F.R. 1.76, a claim of priority is included in an Application Data Sheet filed concurrently herewith. Accordingly, the present invention is a continuation-in-part of U.S. patent application Ser. No. 14/137,347 entitled "Durable Wall Construction" filed Dec. 20, 2013 the contents Of which are incorporated herein by reference.

FIELD OF THE INVENTION

The present invention is directed to the construction industry and, more particularly to a durable wall system and construction method.

BACKGROUND OF THE INVENTION

Most traditional residential construction is still carried out utilizing conventional methods and materials such as wood or metal frame structural components, masonry block, precast concrete panels, and cast-in-place concrete forms. These types of construction are universally recognized, but they require a high degree of sophistication and training in order for them to be useful. Most of these traditional construction methods are both costly and time-consuming.

Large numbers of "prefab" or "modular" building systems have been brought to the market in recent years. These systems require a central manufacturing facility, and experience high acquisition and transportation costs for all the necessary materials. These modular construction methods also sacrifice the ultimate durability and longevity of the resulting structure, where too much emphasis has been placed on cost-reduction in order to meet limited construction budgets.

There has been some utilization of pressurized concrete or "shotcrete" for wall construction over the past few years. Shotcrete has unique qualities such as high strength, crack resistance, prolonged durability, and low permeability, making it much more water resistant and more resistant to seismic activity than other forms of concrete. There have been several wall systems over the years that use shotcrete or pressurized concrete, none of which has been highly successful.

The two most common types of shotcrete wall systems use either a Styrofoam core to which shotcrete is applied, or a steel panel of some description to which shotcrete is applied. Both of these methods generally require shotcrete to be applied to both sides of the wall. The Styrofoam panel system is inherently weaker, and therefore, makes it less durable and less suitable where high wind or seismic conditions exist. The systems that use various types of steel mesh to which the shotcrete is applied are much stronger, and as a result, they are more durable. The problem with these systems is that it is more difficult to apply the shotcrete to the walls because there is no rigid panel or diaphragm on which to place the shotcrete during the application process. The more the panels or diaphragms move during application, the more difficult it is to get the shotcrete to adhere to the panel surface, where the flexing of the panels increases the rebound effect of the shotcrete, resulting in unacceptable amounts of wasted concrete.

There is still much room for improvement when utilizing shotcrete to form the primary walls in any type of structure. The construction market needs a concrete and steel mesh building system that is strong, fast, and economical. The necessary building system and process to achieve these goals cannot require excessive amounts of costly skilled labor and cannot create excessive amounts of wasted materials.

SUMMARY OF THE INVENTION

The present invention is a building technology consisting of a process used for the rapid construction of virtually any type of structure that requires a concrete foundation along with an integrated, contiguous steel and concrete wall assembly. The primary application of this building process is geared toward the rapid construction of affordable, low-maintenance, and highly durable single-family and multi-family dwellings.

For simplicity, the building process and system components are herein described in terms of assembling a single wall section and foundation slab section between two fixed points. In practical application in the field, however, it will be used to construct a complete foundation slab and an integrated series of conjoined walls that will constitute the entire shell or frame of a completed dwelling structure. The walls can include all of the interior walls as well as the exterior structural walls, where applicable.

First, a suitable concrete foundation, or floor slab, consisting primarily of concrete and steel, must be constructed, the specific ingredients, thickness and strength of which will be determined by soil type and conditions, and related geological, topographical and climatological conditions at a given construction site. The key elements that must be imbedded in the foundation, which are necessary for the construction of the integrated wall system above it, are as follows.

Steel rebar dowels with a standard angled hook, hereinafter called "dowels", are cut to a specified length and must be imbedded in the foundation at each directional change of the structure, and at various points along the wall and foundation where intersecting walls will connect to the primary wall. These dowels, serving as tie-in rods, will protrude above the surface of the foundation and extend upward two to three feet, as required to meet any applicable engineering overlap requirements. The protruding dowels are positioned in the foundation so as to extend upward directly at the center of the wall as it relates to the external surface edge of the foundation slab.

Additional steel reinforcement is then positioned and embedded in the foundation along the entire length of the foundation slab. This reinforcement will be in the form of a continuous strip of welded-wire fabric, and/or rebar placed at various intervals, depending upon strength requirements. This reinforcing steel will extend above the surface of the foundation or floor slab up to three feet, depending on engineering and code requirements, and will be positioned so that it will be at, or close to, the center of the intended vertical walls. Concrete is then poured within a series of forming boards outlining the entire perimeter of the intended dwelling structure, to form the foundation slab, and is then allowed sufficient time to cure and harden in order to permit further construction and assembly activities on top of the foundation slab.

Pieces of steel rebar of suitable gauge, the length of which will describe the approximate height of the intended wall, are then placed on the surface of the foundation slab, next to each of the steel tie-in dowels at each directional change, protruding from the cured foundation slab. Each of these vertical rebar support rods is tied to its corresponding, protruding tie-in dowel, using steel rebar tie wire, so that each vertically-oriented rebar support rod stands unaided.

From this point forward, a single wall section will be described, unless otherwise noted. A specially designed temporary guiderail connector, hereinafter referred to as a "connector", is placed on top of each vertical steel rebar support rod, at the end of each wall section. Each connector has a steel sleeve which aligns it on the rebar support rod, and the connector is held in place by gravity. Next, a specially designed temporary upper guiderail the approximate length of the wall section, hereinafter referred to simply as a "guiderail", is slid down in place over the connectors at the top of each end of the wall section, and is held in place by gravity. A locking pin is inserted horizontally through each side of the guiderail where it intersects with each guiderail connector, capturing the connector, and stabilizing the guiderail and connector longitudinally, vertically and horizontally.

A sheet of welded-wire fabric of sufficient gauge and strength which is cut to the approximate height of the intended wall is then placed and aligned vertically on the foundation at the approximate center location for the wall. The welded-wire fabric rests on its edge directly on the concrete foundation floor slab. The welded-wire fabric sheet is secured in place by tying it to the welded-wire fabric and/or rebar tie-in dowel supports which are extending vertically out of the foundation slab. The top edge of the vertically erected welded-wire mesh is secured in place by inserting it into a series of locking devices or protrusions in the underside of the guiderail. The temporary upper guiderail and guiderail connectors simply serve to stabilize the top of the welded-wire mesh wall panel assembly during the subsequent application of concrete to the wall panels described herein below.

At this stage, there is now one primary structural layer of welded-wire fabric running the length and height of each wall section. The primary structural welded-wire fabric sheeting is firmly secured at the bottom to the foundation steel, and stabilized at the top in the underside of the temporary guiderail. Any additional layers of welded-wire mesh called for in a given design that will eventually become part of the aggregate structural panel of each wall will be attached to, and supported by, this primary structural layer of welded-wire mesh.

To the extent a given unit design specifies a roofing system utilizing trusses, roof truss anchors are then fitted up through slots located periodically in the guiderails at predetermined points, based on the applicable roof truss design for the given structure. The roof truss anchors can be temporarily affixed to the upper guiderail and/or may be tied to any portion of the structural steel rebar or mesh components in the wall panel, beneath the guiderail. To the extent the unit design plan specifies a flat concrete roof, rebar hook dowels, rather than truss anchors, are utilized, and are secured to horizontal rebar components in the wall panel, beneath the guide rail. The upper portion of each rebar hook dowel for the concrete roof protrudes above the upper guide rail.

Next, sheets of perforated expanded metal mesh, hereinafter referred to as "rib lath", are then secured vertically to the structural welded-wire mesh, for the entire length of the wall. The rib lath extends from the foundation slab up to the underside of each temporary upper guiderail. The sheets of rib lath have an abundance of perforations or pre-formed slots in it, and serves as the underlying layer of steel mesh material to which concrete will be applied on both sides, typically at a predetermined pressure, from a device such as a shotcrete pump.

Prior to the application of concrete to the rib lath, additional layers of welded-wire fabric of different sizes and configurations can be added to one or both sides of the existing structural wall assembly depending on strength requirements and the thickness of the desired, resulting wall. The combination of structural welded-wire mesh and additional sheets of steel mesh described above are used to reinforce the concrete, and in this application, are also used to stabilize and support the entire structural assembly of each wall until the concrete can be applied, as well as stabilizing the rib lath while the concrete is being applied at a specified level of pressure.

In short, the aggregate wall structure assembly and configuration describe above, hereinafter referred to as a "structural panel", will consist of one layer of the structural, self-supporting welded-wire fabric, one layer of rib lath, and, optionally, can include one or more additional layers of welded-wire fabric on one or both sides of the rib lath, all of which are secured to, and supported by, the original structural layer of self-supporting welded-wire fabric and vertical rebar support rods.

Concrete is then applied to both sides of the structural panel and allowed to cure. All steel layers of the structural panel and all supporting rebar components are covered and encased completely in concrete, from the foundation slab up to the underside of the temporary upper guiderail, thus establishing the completed walls. Once the concrete is sufficiently cured, the temporary upper guiderails and guiderail connectors that had been used to simply stabilize the structural wall panels are removed, leaving the finished concrete and steel walls ready for the application of the concrete flat roof or truss-based roofing system called for in the given design specifics.

Other objectives and further advantages and benefits associated with this invention will be apparent, to those skilled in the art, from the description, examples and claims which follow.

DETAILED DESCRIPTION OF THE PREFERRED EMBODIMENT

Figures 1A, 1B:
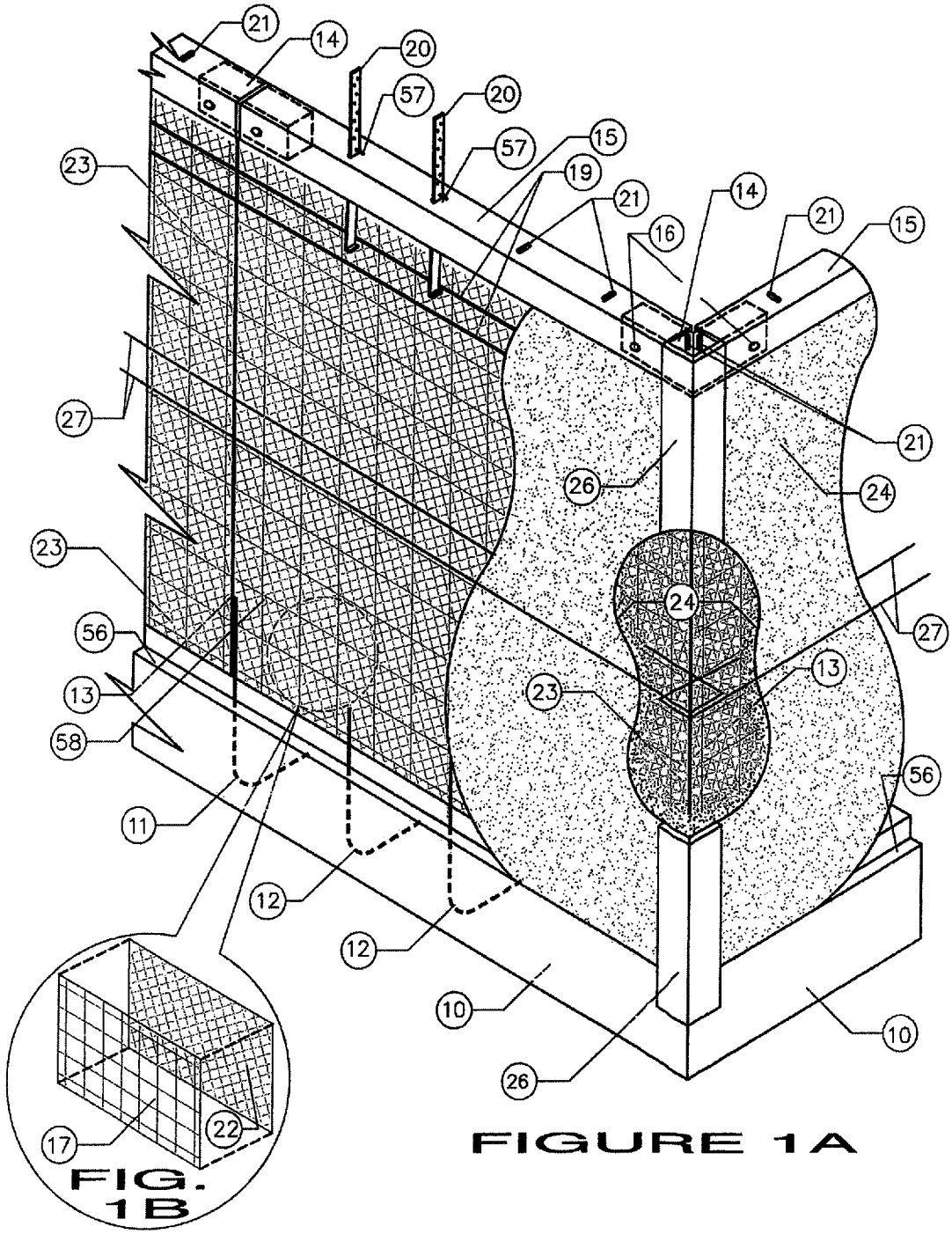
FIG. 1A is a three-dimensional diagram of two intersecting wall panes showing the structural panel and its various components with the concrete applied.
FIG. 1B is an enlarged section of FIG. 1A.

The following detailed description depicts a construction process and methodology that provides significant improvements over existing shotcrete panel systems in speed of assembly, simplification, construction stability, and reduction of materials waste. For simplicity, the construction methodology will be demonstrated by describing the assembly of one wall section between two vertical supports. This wall section could represent the wall between two corners of a structure or a representative section of a longer, straight wall.

The present invention involves a building system, implemented via a unique construction method and process that provides for the construction of a fully-integrated foundation and series of exterior and interior walls comprised of steel mesh and pressurized concrete, utilizing specialized, purpose-built, re-useable assembly components. Units can be built from virtually any structural layout or design. This process is particularly desirable for projects where the resulting dwellings or structures must be more durable and cost-effective than traditional construction methods and materials can provide. The subject system of construction allows the builder to erect the integrated foundation and all of the walls of the structure quickly and efficiently, without the need for expensive forms or costly skilled labor. The ability to utilize unskilled labor allows the user to construct a large number of structures in a shorter period of time, and, utilizing re-useable system components in the process, allows for the prompt, reliable and consistent reproduction of a given unit type or design in the field. The reusable components of this system give the user an advantage with respect to speed of construction, consistency, and economy, while also eliminating certain aspects of waste and delay that is typical of more traditional construction processes. Standard engineering applications make this construction process readily acceptable in every state and county in the United States.

The foundation utilized in this invention can be built separately from the floor slab or it can be built and poured monolithically where the foundation and floor slab are poured at the same time. Our diagrams show the monolithic configuration and integrated assembly process. The monolithic foundation and floor slab 10, hereinafter called the "floor slab", is prepared first as shown in FIGS. 1 and 2. The size and configuration of the floor slab 10 is determined by subsurface soil conditions and engineering requirements. Key elements are required in the floor slab 10 for this invention. A steel rebar dowel with a standard angled hook 11, hereinafter called the "dowel" as seen in FIGS. 1 and 2, must be placed at every corner, intersecting wall, and along walls of sufficient length that they would require a continuation or inline connector, per FIG. 3. The dowel 11 will be placed at or close to the center of the proposed wall. These dowels will usually be #5 rebar and will extend approximately thirty inches vertically above the finished floor slab 10. Additional dowels 12 are positioned along the wall at or close to the center of the proposed wall. The additional dowels 12, as shown in FIGS. 1 and 2 are typically #4 or #5 rebar and are positioned at periodic intervals along the length of each wall at 48 inches on center, or less, depending on engineering requirements. As an alternate to the additional dowels 12, a continuous strip of welded-wire fabric 58, can be installed into the foundation instead, FIG. 2B. Note that the floor slab 10 is designed with a 3.5-inch water stop recess or notch 56, hereinafter referred to as the "notch", built into its outside edge. This notch 56 will be filled with concrete when the outside surface of the wall is sprayed with shotcrete, per FIGS. 1, 2 and 4.

Once the floor slab 10 is poured and cured, a vertical support rod consisting of a length of steel rebar reinforcing rod 13, herein after referred to as the "vertical support", FIGS. 1, 4, 5, and 8, is positioned on the floor slab 10 next to each dowel 11. The vertical support 13 is placed in line with the direction of the wall where it is tied to the dowel 11 using steel wire ties. The vertical support 13 is of sufficient length that it defines the height of the intended wall. Guiderail connectors 14, FIGS. 1, 3, 6, and 8, are then placed on top of the vertical supports 13. The guiderail connectors 14 are designed with a specified receiving sleeve 28 attached to their underside, which receiving sleeve 28 is slid down over the top end of the vertical support 13, FIGS. 3, 5, 6, and 8, and are held in place by gravity. The top of the receiving sleeve 28 is fitted with a plug 29 at its upper end that keeps the top of the vertical support 13 approximately one inch below the top of the finished wall, FIG. 6. A removable upper stabilizing guiderail 15, hereinafter referred to as "guiderail" is now slipped over the guiderail connectors 14 on each end of the wall section, FIGS. 1 and 8. A locking pin 16 is placed through the guiderail 15 and into the guiderail connector 14, locking them together, FIGS. 1, 5, and 8.

Figure 4:
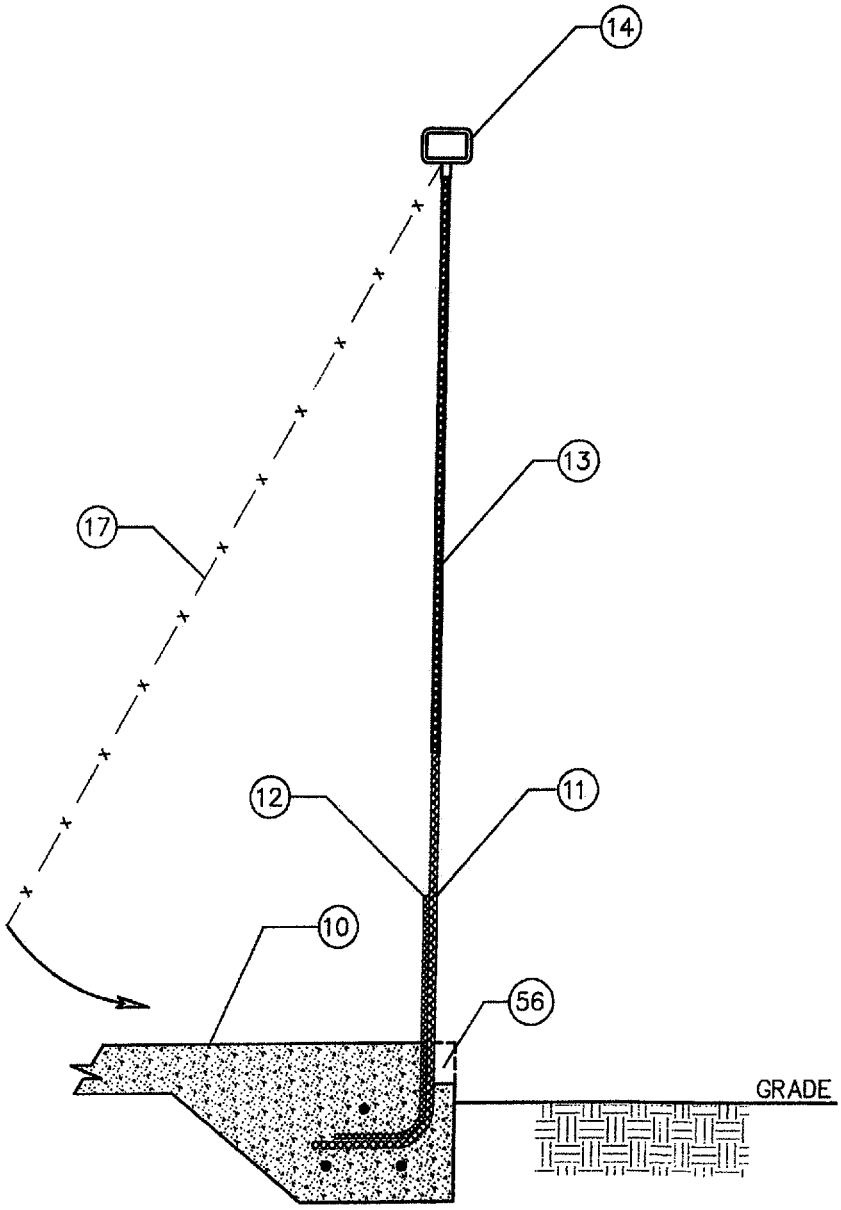
FIG. 4 is a diagram showing the installation of the primary structural layer of welded-wire fabric.
Figure 5A:
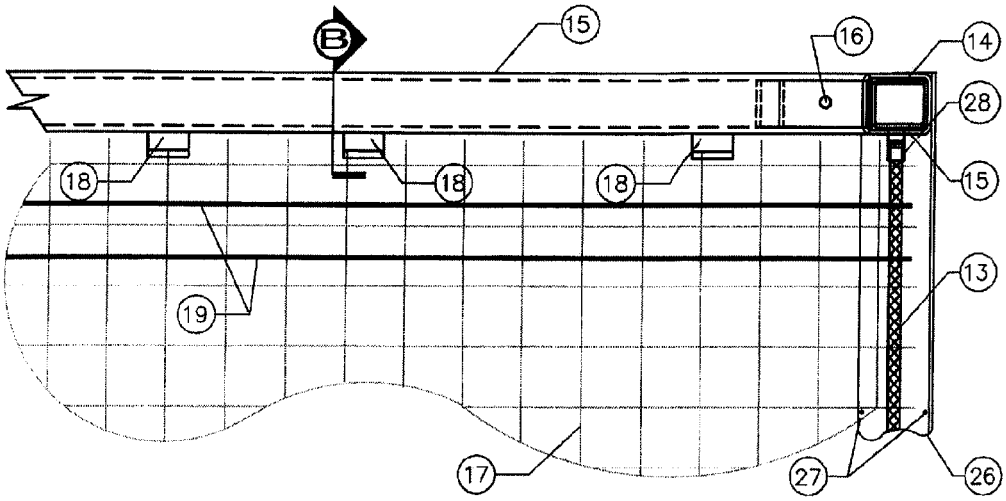
FIG. 5A is a diagram of the guiderail connected to a guiderail corner connector at one end.
Figure 5B:
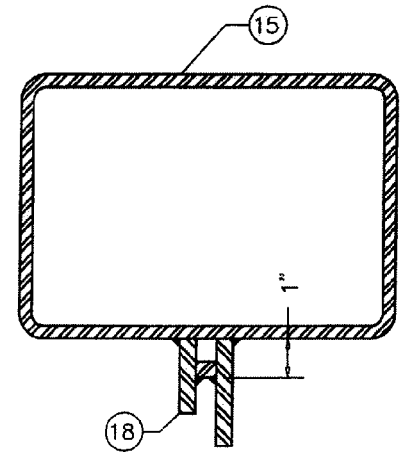
FIG. 5B is a diagram showing a cross-section of a guiderail and its aligning tab.
Figure 5C:
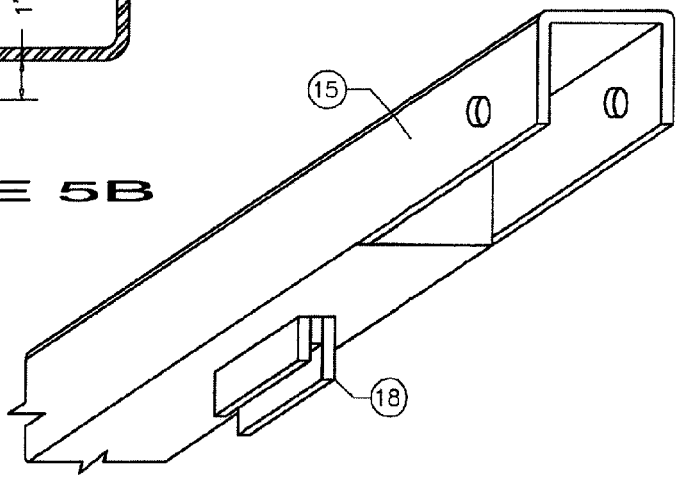
FIG. 5C is a diagram illustrating the underside of a guiderail and aligning tabs.

The top strand of the welded-wire fabric sheet 17 is lifted up so that it engages the several aligning tabs 18 located on the underside of the guiderail 15, FIGS. 4 and 5. The bottom edge or strand of the welded-wire fabric 17 is then slid horizontally until it is fully vertical and is wedged between the underside of the guiderail 15, and the top of the floor slab 10 upon which it is resting, FIGS. 1 and 4. The bottom edge of the welded-wire fabric 17 abuts firmly against the additional dowels 12 or welded-wire fabric 58, positioned along the wall, which extend vertically out of the floor slab 10. Please note that for clarity, the optional welded-wire fabric 58, if called for in a specific design, would be located in the same position as, and/or in addition to, the dowels 12, as shown on FIG. 2B. The additional rebar dowels 12 and/or the optional welded-wire fabric 58 and the welded-wire fabric 17 are tied together using steel wire ties. The welded-wire fabric is of sufficient strength and gauge so that it is self-supporting, and will stand in a vertical position when resting vertically on the slab and stabilized above from each side by the spaced apart aligning tabs 18 along the underside of the guiderail 15.

One or two rows of reinforcing horizontal rebar 19 are attached to the outside surface of the welded-wire fabric 17 as shown in FIGS. 1 and 5. The number of rows and size of horizontal reinforcing rebar 19 are determined by engineering requirements for a given structure. Assuming one row of horizontal rebar 19 is used, it is attached to the outside surface of the welded-wire fabric 17 at the second strand from the top of the fabric sheet, approximately six inches below the underside surface of the guiderail 15. Note that the first strand of welded-wire fabric 17 is already wedged securely in the aligning tabs 18 in the guiderail 15 as described above. If two rows of horizontal rebar 19 are required, the second row will be attached to the third strand from the top of the welded-wire fabric 17, approximately twelve inches below the guiderail 15. The horizontal reinforcing rebar 19 is tied to its corresponding, horizontal strand of welded-wire fabric 17, with steel wire ties.

Figure 6A:
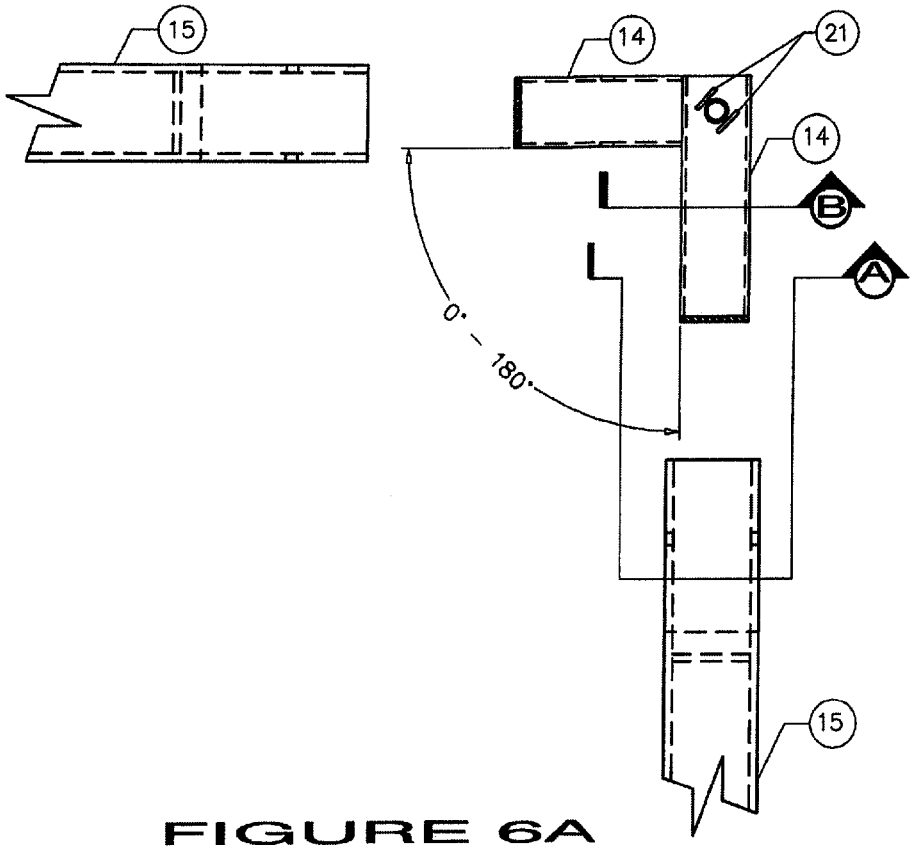
FIG. 6A is an exploded view of a guiderail connector as it relates to the guiderail.
Figure 6B:
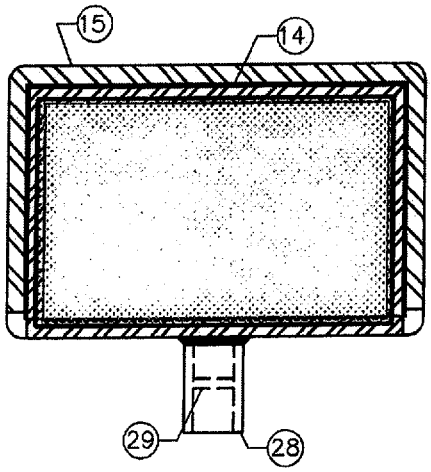
FIG. 6B is section A of FIG. 6A.
Figure 6C:
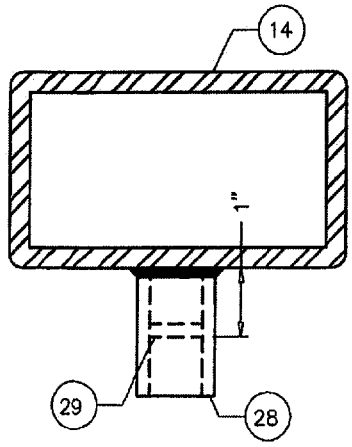
FIG. 6C is section B of FIG. 6A.
Figure 8:
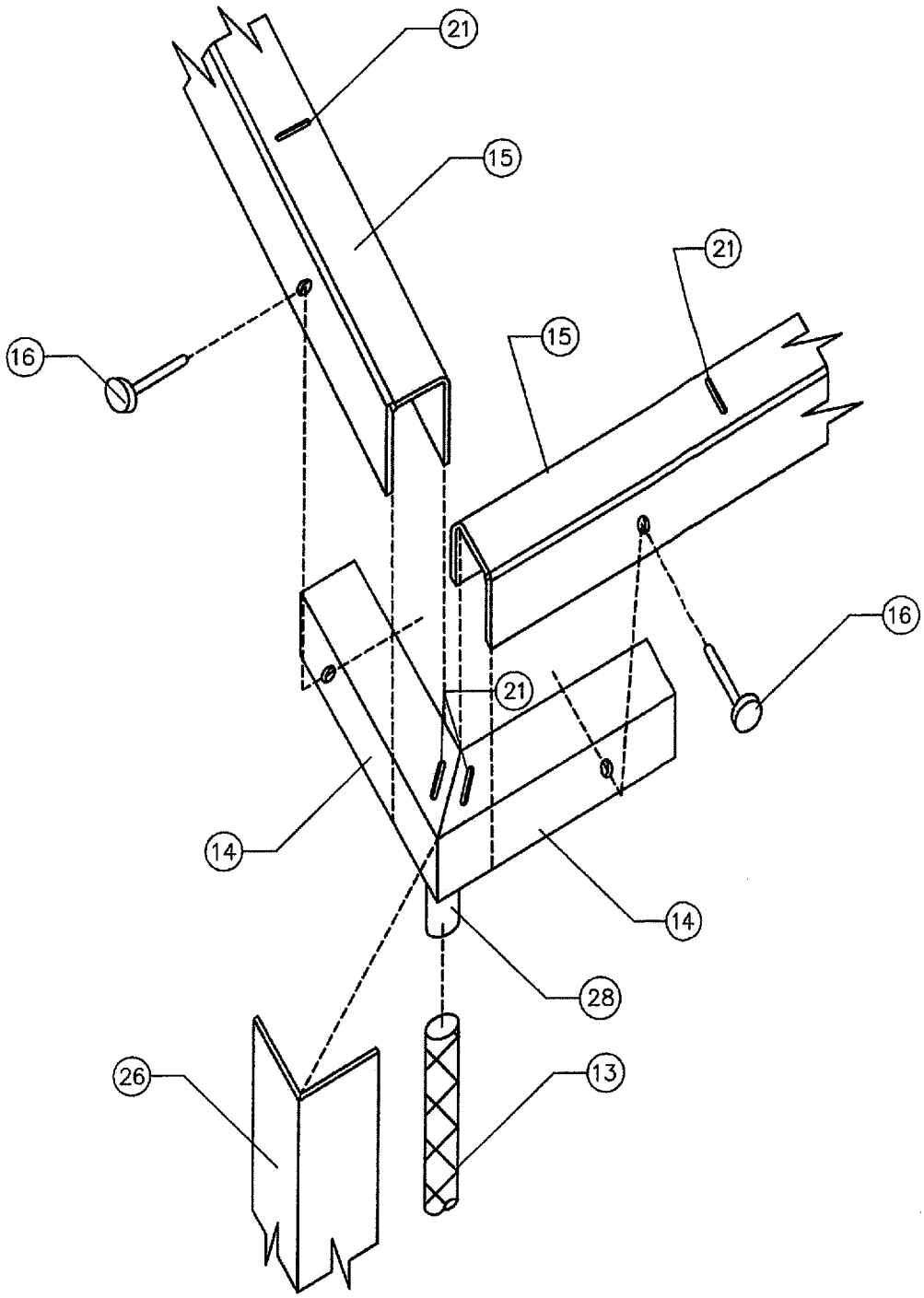
FIG. 8 is an exploded diagram of a guiderail corner connector with its associated guiderails.
Figure 9A:
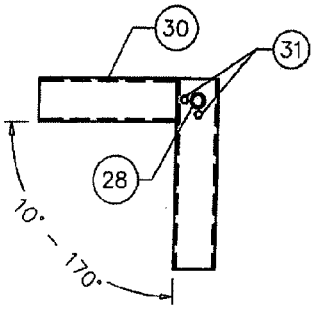
FIG. 9A is a top view of a corner guiderail connector.
Figure 9B:
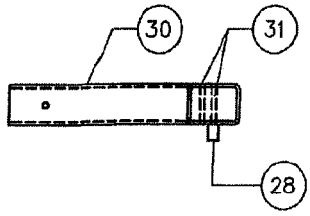
FIG. 9B is a side view of a corner guiderail connector.
Figure 9C:
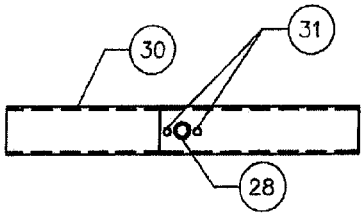
FIG. 9C is a top view of an inline guiderail connector.
Figure 9D:
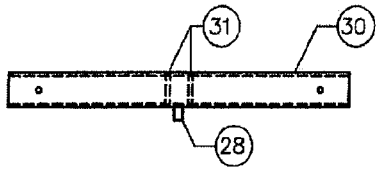
FIG. 9D is a side view of an inline guiderail connector.
Figure 9E:
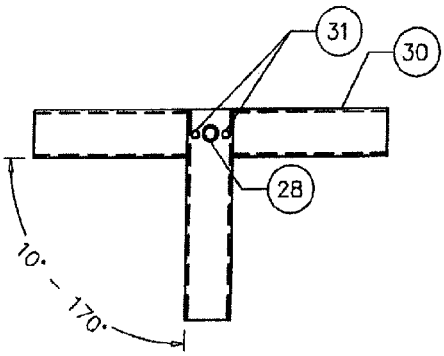
FIG. 9E is a top view of an intersecting wall guiderail connector.
Figure 9F:
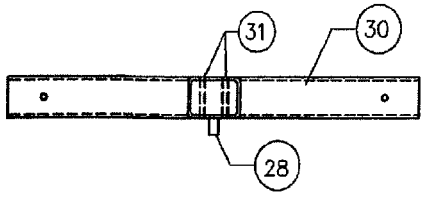
FIG. 9F is a side view of an intersecting wall guiderail connector.

To the extent a given unit design specifies a roof system utilizing trusses, roof truss anchors 20 are placed up through linear slots 21 that are present throughout the guiderail 15, FIGS. 1, 6, and 8. The linear slots 21 pre-cut into the guiderail are positioned at intervals along the guiderail 15 in accordance with the engineered roof truss design for the given structure, and are perpendicular to the external vertical surface of the guiderail 15, except for the slots for the hip trusses in the corners, which slots are cut at a 45-degree angle to the external vertical surface of the guiderail 15, as shown in FIGS. 1, 6, and 8. Once the roof truss anchor 20 is placed up through the linear slot 21, an optional locking pin 57 can be placed through one of the holes in the roof truss anchor 20 at a point above the guiderail 15 to temporarily secure it during the construction process, as shown in FIG. 1. The roof truss anchors 20 may alternately be secured by tying them to one of the rows of reinforcing horizontal rebar 19 that is attached to the welded-wire fabric 17, and/or directly to the welded-wire fabric 17, with steel wire ties. The bottom of each roof truss anchor 20 is positioned approximately six to twelve inches below the top of the wall, depending upon design requirements, so that the lower portion of it that is extending below the guiderail will ultimately be imbedded and surrounded by concrete. The roof truss anchors 20 do not support any portion of the structural panel 23 as shown in FIG. 1.

Figure 19:
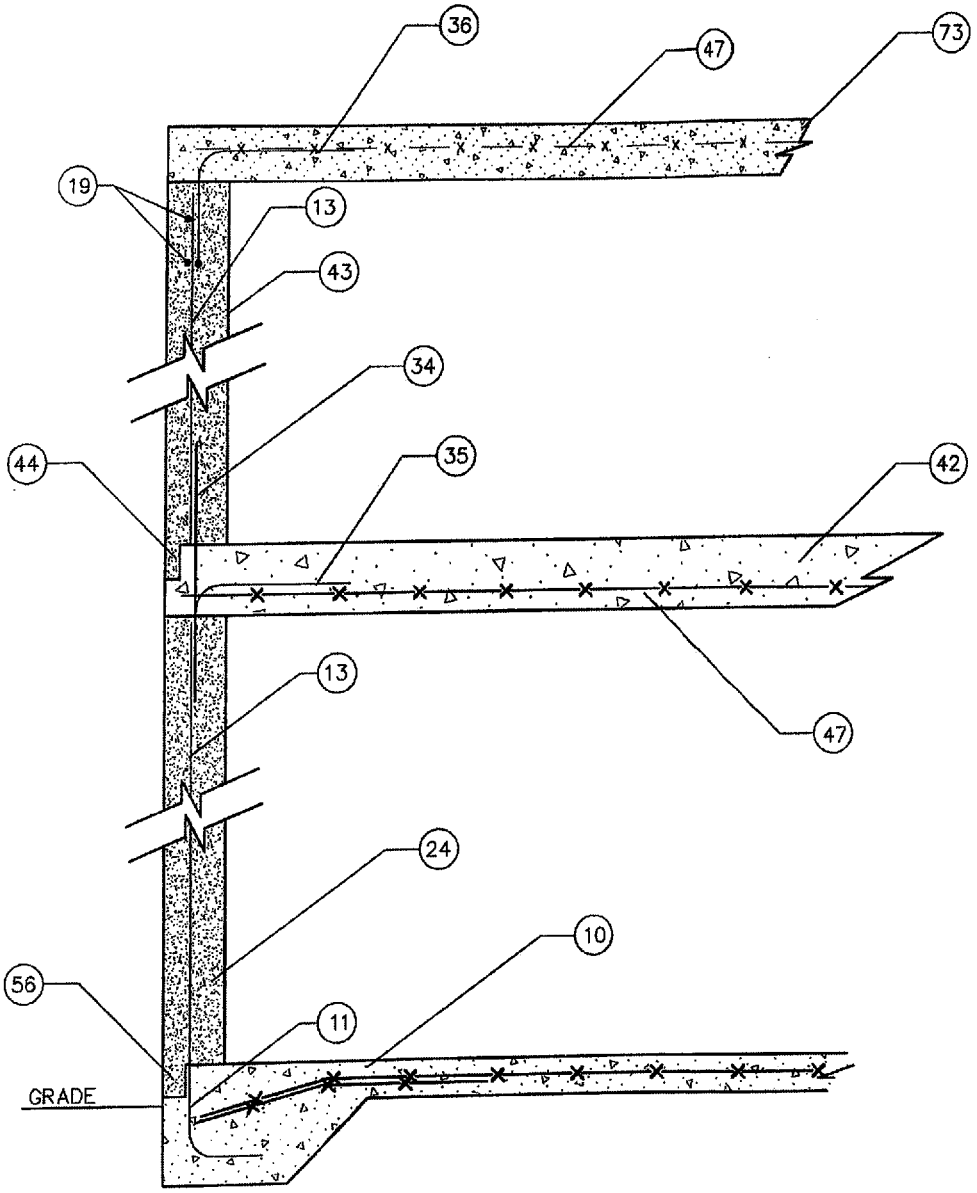
FIG. 19 is a cross-section of a multi-story structure with a concrete second-floor slab and a concrete flat roof.
Figure 20:
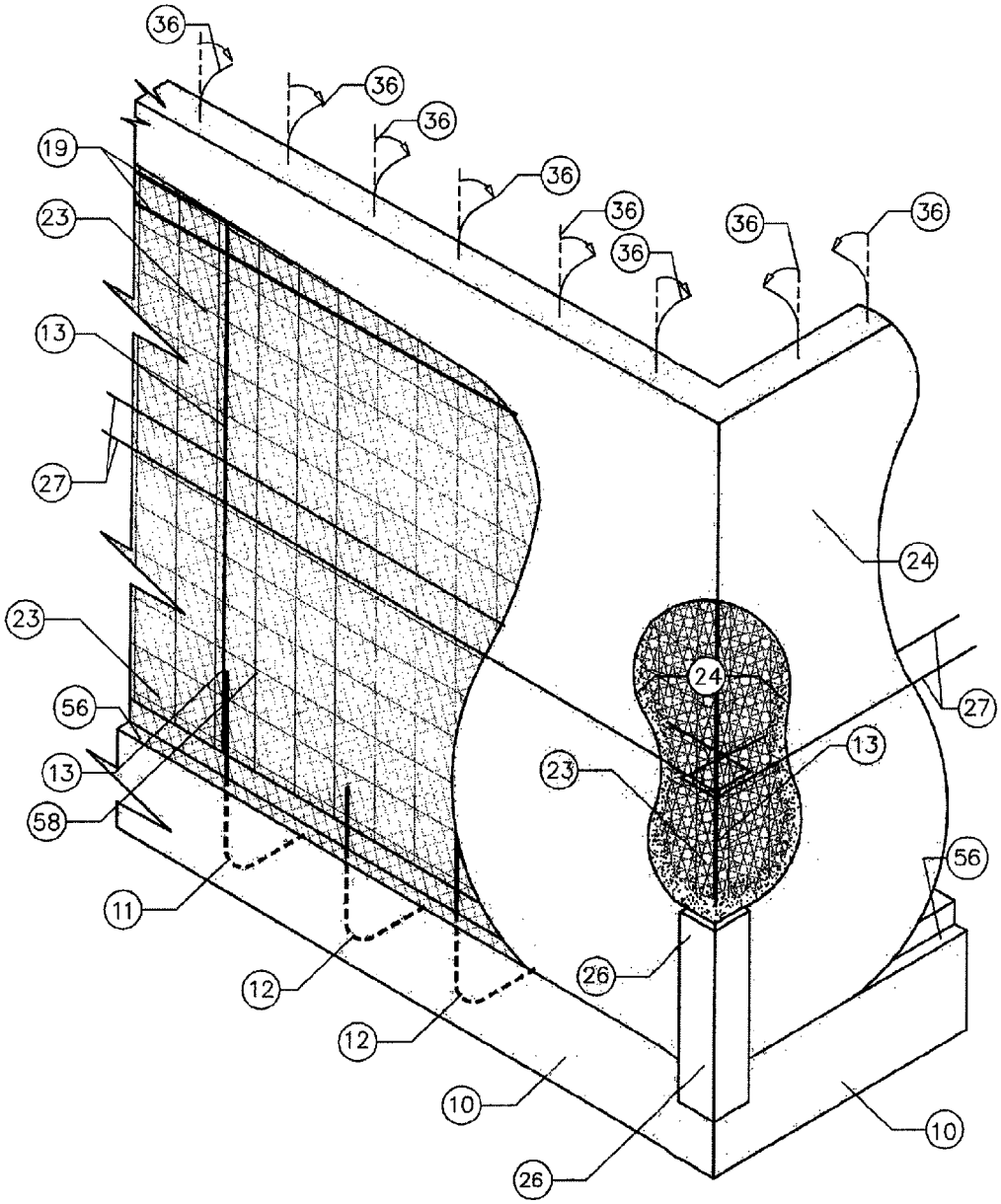
FIG. 20 is a three-dimensional diagram of two intersecting walls panes, showing their various components including the tie-in rebar connecting the top floor to the roof.

In the event a given unit design alternately specifies a flat concrete roof rather than a roof system utilizing trusses, standard rebar hook dowels 36 are utilized rather than truss anchors, FIG. 20. The standard rebar hook dowels 36 are tied to the reinforcing horizontal rebar 19 utilizing steel wire ties, and protrude above top of the wall, FIGS. 19 and 20. The number and placement of the standard rebar hook dowels 36 will be determined by engineering and design requirements.

Figure 7:
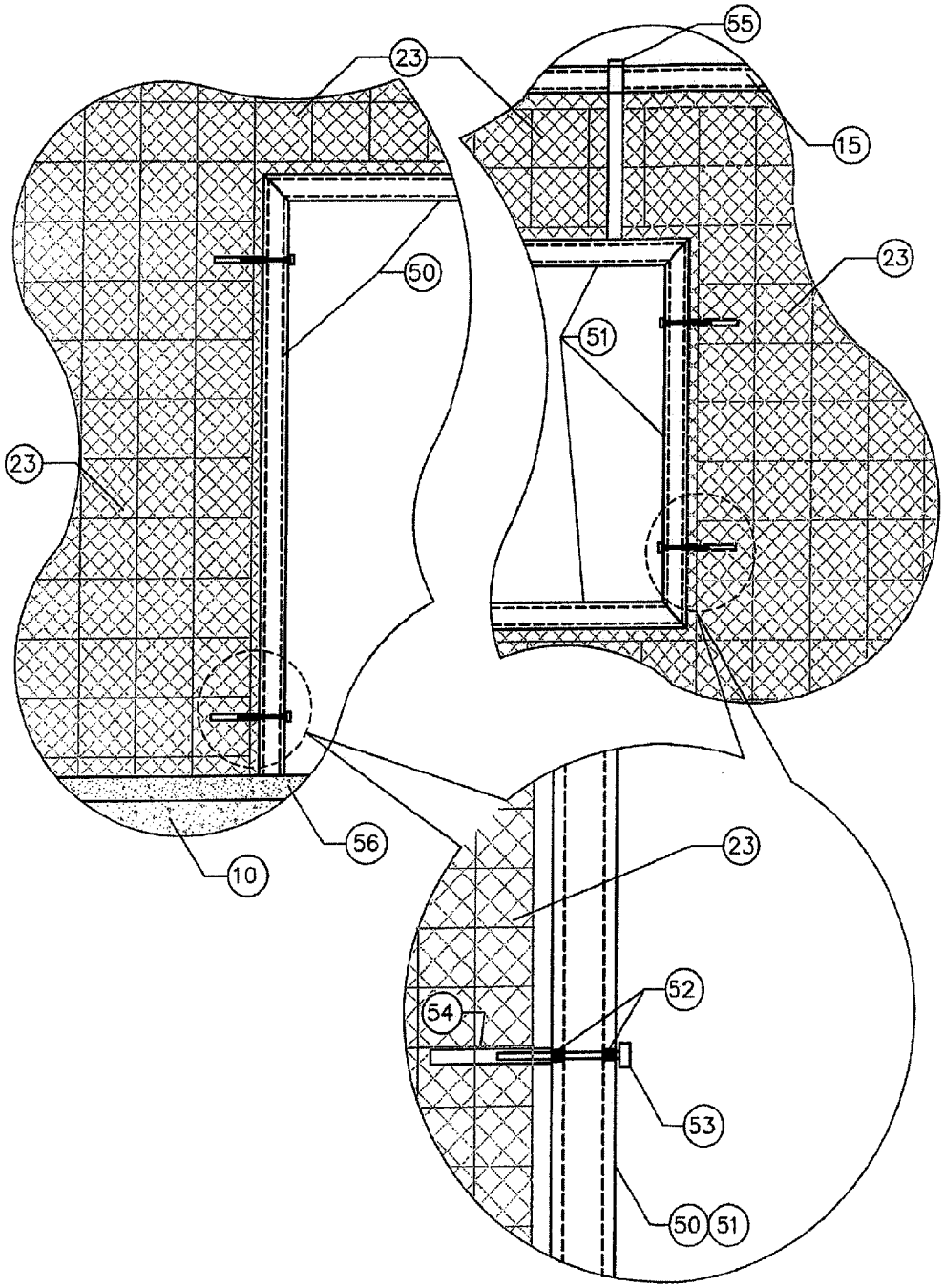
FIG. 7 is a diagram of door and window placement holder installation.

Sheets of rib lath 22, which is a form of expanded metal mesh, are applied to the inside surface of the welded-wire fabric 17, as shown in FIG. 1, for the entire length of each section of a wall. The rib lath 22 is set on the surface of the floor slab 10 and runs vertically up to within approximately one-half of an inch from the underside of the guiderail 15. The rib lath panels 22 are secured to the welded-wire fabric 17 with steel wire ties periodically at various intervals, as shown in FIG. 1. The combination of welded-wire fabric 17 and rib lath 22 comprises the structural panel 23 as shown in FIGS. 1 and 7. The structural panel 23 comprises the surface to which concrete will be applied. Alternatively, the structural panel 23 can also contain one or more additional layers of welded-wire fabric 17 attached to either side of the structural panel 23, depending on the strength requirements and dimensions proscribed for the given wall design of a particular structure.

If there are to be any openings in the wall, such as doors and windows, they must be accommodated for at this time. Once the structural panel 23 is in place, openings are cut of sufficient size to provide for the doors and windows in accordance with the given unit design. Door placeholders 50 and window placeholders 51 are placed into each opening, framing out the openings, as follows. The placeholders for doors 50 and for windows 51 can be made out of the same material as the guiderails 15, or they can be made out of aluminum, plastic or wood. If they are to be made out to the same material as the guiderail 15, the corners of the placeholders 50, and 51 are mitered on a 45-degree angle and welded so that there are no open seams. Placeholders for doors 50 and windows 51 are shown in FIG. 7. The outside dimensions for these door placeholders and window placeholders 51 are provided by the respective manufacturer and are referred to as masonry openings. The placeholders for doors 50 and windows 51 have holes 52 placed in each vertical member as shown in FIG. 7. The door placeholders 50 are placed directly on the floor slab 10. They are held in place by inserting a locking pin 53 through each of the holes 52 located on the door placeholder 50. A locking pin receiving sleeve, 54 is slipped over the terminal end of each locking pin 53 once it is in place. Each locking pin receiving sleeve 54 is tied to the outside surface of the welded-wire fabric 17 using steel wire ties. This configuration positions the door placeholder 50 in the center of the wall, and holds it firmly in place during the later application of the shotcrete.

The window placeholders 51 are secured in the same manner as the door placeholders 50. They are held in place using two window placeholder hangers 55 that are hung over the guiderail 15 and are secured to both sides of the window placeholder 51 with metal screws at a predetermined height. Once the window placeholder 51 is held in position, four locking pins 53 are inserted through the holes 52 in the window placeholder 51. The locking pin receiving sleeves 54 are placed over the terminal end of the locking pins 53. The locking pin receiving sleeves 54 are then tied securely to the outside surface of the welded-wire fabric 17 with steel wire ties.

An alternate method of securing the window placeholders 51 in their proper position is to place the locking pins 53 through the holes 52, and place the locking pin receiving sleeves 54 over the terminal end of the locking pins 53. The window placeholder 51 is then held in place while the locking pin receiving sleeves 54 are tied to the outside surface of the welded-wire fabric 17 using steel wire ties. Utilizing this method, the two window placeholder hangers 55 would not be required. Either of these two methods of attaching the door and window placeholders, 50 and 51, respectively, can be utilized no matter what material is used for the construction of the door and window placeholders, 50 and 51. In the event additional or other openings are required in a wall panel for air conditioning units, vents, and other unit construction features that may be called for in a given unit design, the same style of placeholders will be fabricated and used with the same assembly process utilized for the window and door placeholders.

A corner gauge bracket 26, which is an "L" shaped device the width of the wall running in each direction, is placed at each corner of the wall panel, as shown in FIGS. 1, 5, and 8. The corner gauge bracket 26 is attached to each corner of the structure by capturing the outside corner of the floor slab 10, at the bottom, and extends up to capture the outside corner of the guiderail connector 14. The corner gauge bracket 26 serves two important functions. First, it defines the exact edge of the corner of the exterior of two intersecting walls as the structure is subsequently being sprayed with shotcrete. This provides a precise corner without any excess waste of concrete. Second, when applied to the external corner of the structure, the corner gauge bracket defines the precise width of the wall. With the gauge brackets in place, strands of Gunite wire or piano wire, hereinafter collectively referred to as gauge locators 27, are looped around the outside of the gauge brackets 26, located at opposite ends of the wall, and tightened as shown in FIG. 1. Depending on the height of the wall, as few as one or as many as three vertically-spaced gauge locators 27 can be placed along the height of the corner gauge bracket 26 to secure it in position.

Shotcrete is now sprayed on both sides of the structural panels 23 throughout the structure. Excess shotcrete is screeded or shaved off flat, using the gauge locators 27, the edge of the guiderail 15, and the outside surface of the floor slab 10, as guides for the screeding and surface-leveling process, throughout the structure. Once the concrete has had sufficient time to cure, the gauge locators 27, the locking pins 16, the corner gauge brackets 26, the guiderails 15, and the guiderail connectors 14 are all removed, and may then be reused on the next structure. The locking pins 53 for the door 50 and window 51 placeholders are removed. The door and window placeholders 50 and 51 are removed as well. The remaining structure, once cured, consists of a solid, level, concrete-and-steel wall frame describing the entire structure. The roof truss anchors 20, FIG. 1A, for a specified truss-based roof, or alternatively the standard rebar hook dowels 36, FIG. 20, for a specified concrete flat roof, are embedded in and are extending above the top of the walls, ready to receive and connect to the roofing system.

Figure 2A:
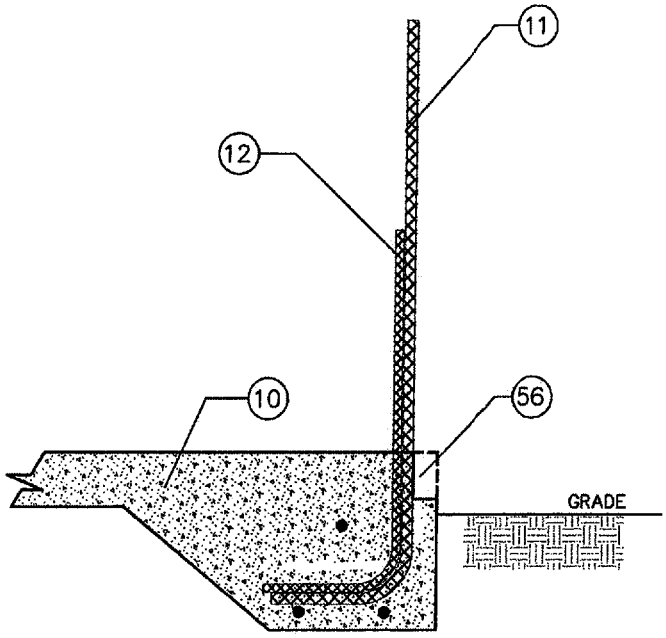
FIG. 2A is a diagram of a monolithic foundation and floor slab depicting concrete configuration and steel reinforcement, as well as rebar vertical support stub out dowels.
Figure 2B:
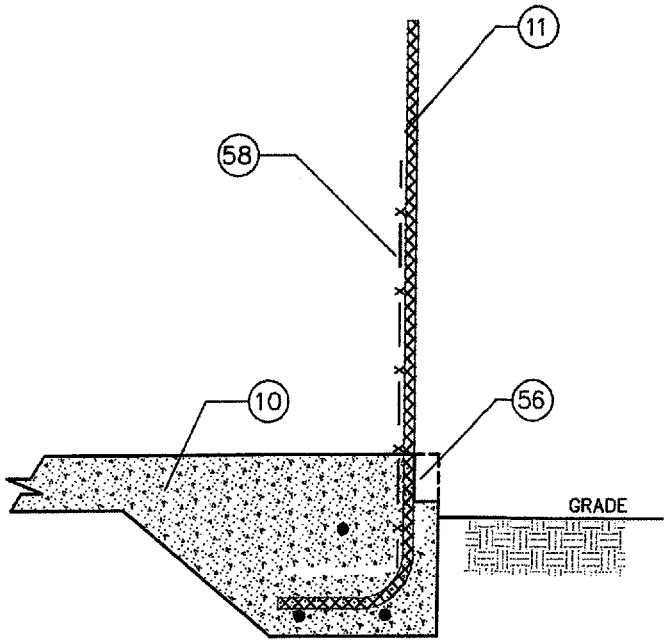
FIG. 2B is a diagram of a monolithic foundation and floor slab depicting concrete configuration and rebar vertical support stub out dowel, as well as welded-wire fabric.
Figure 3A:
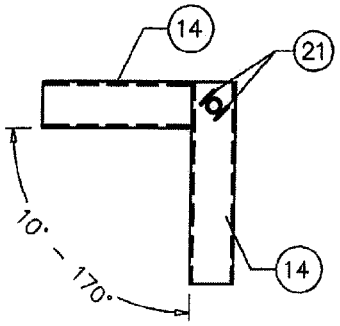
FIG. 3A is top view of a corner connector.
Figure 3B:
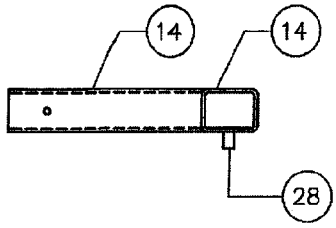
FIG. 3B is a side view of the corner connector shown in FIG. 3A.
Figure 3C:
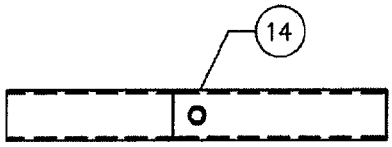
FIG. 3C is a top view of an inline connector.
Figure 3D:
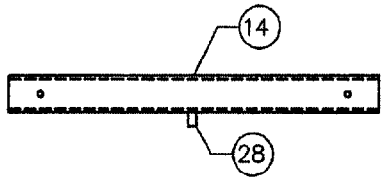
FIG. 3D is a side view of the inline connector shown in FIG. 3C.
Figure 3E:
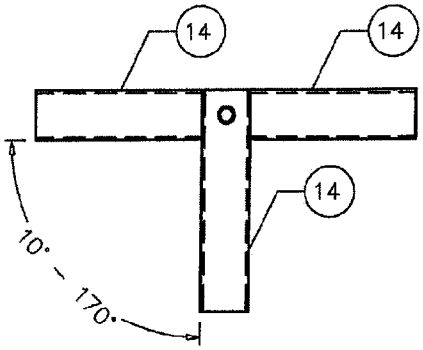
FIG. 3E is a top view of an intersecting wall connector.
Figure 3F:
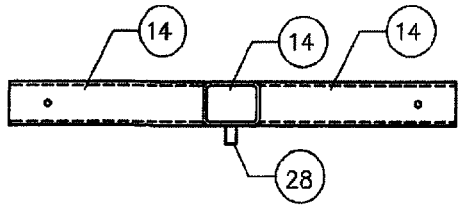
FIG. 3F is a side view of the intersecting wall connector shown in FIG. 3E.

Certain design specifications for a given unit may alternatively call for the construction of more than one level, or floor, to the unit structure. The following detail describes the additional and alternative methods and processes for utilizing the present invention to construct multi-level structures, as follows:

Multi-story guiderails 32 and multi-story guiderail connectors 30, as shown in FIGS. 9, 10, 11A, 15 and 16B, are used to construct multi-level wall and flooring structures, rather than using the standard guiderails 15 and guiderail connectors 14 shown on FIG. 1A.

Each multi-story guiderail connector 30 has two guide holes 31 drilled through it in close proximity to the receiving sleeve 28, FIGS. 9, 11A, 15, and 16B. The guide holes 31 permit steel rebar hook dowels 33 secured to the structural panel components of the wall below to pass up through and extend above the guiderail connector 30. This permits the protruding upper portion of the standard rebar hook dowels 33 to serve as the base to tie the lower wall to the upper wall components and structures, during the assembly process.

Multi-story guiderails 32 must be used in conjunction with multi-story guiderail connectors 30. Each multi-story guiderail 32 has multiple guide holes 40 and 41 drilled through it to accommodate the passage of multiple steel rebar hook dowels 34 and 35 through the multi-story guiderail 32, FIGS. 10A, 11A, 15, and 16B. The upper portions of the multiple steel rebar hook dowels 34 and 35 protruding above the guiderail 32 and guiderail connectors 30 will later serve as the basis for additional structural tie-ins for the upper level wall panels, and for a concrete flooring slab if called for in the unit plans, FIGS. 10A, 11A and 17A. The multiple guide holes 40 and 41 are located on center at specified intervals along the length of each multi-story guiderail 32, in accordance with given unit design plans, FIGS. 10A and 11A. Each guide hole 40 will permit the extension of each rebar hook dowel 34 upward above the terminating edge of the lower wall, FIG. 17A. In the event a unit design plan calls for concrete flooring between unit levels, then each alternating guide hole 41 will permit the extension of each steel rebar hook dowel 35 upward above the terminating edge of the lower wall, FIG. 17A, permitting each steel rebar hook dowel 35 to be bent over and utilized to secure and strengthen the concrete floor slab which will ultimately comprise the floor surface for the upper level of the unit, FIGS. 10A, 17A and 19.

A multi-story guiderail connector 30 is placed over the vertical support 13 at each end of the wall by means of a receiving sleeve 28 and is held in place by gravity. A multi-story guiderail 32 is now placed over the multi-story guiderail connectors 30 at each end of the wall, and a locking pin 16 is placed through the multi-story guiderail and the multi-story guiderail connector at each end of the wall, FIGS. 11A, 15 and 16B.

Figure 18:
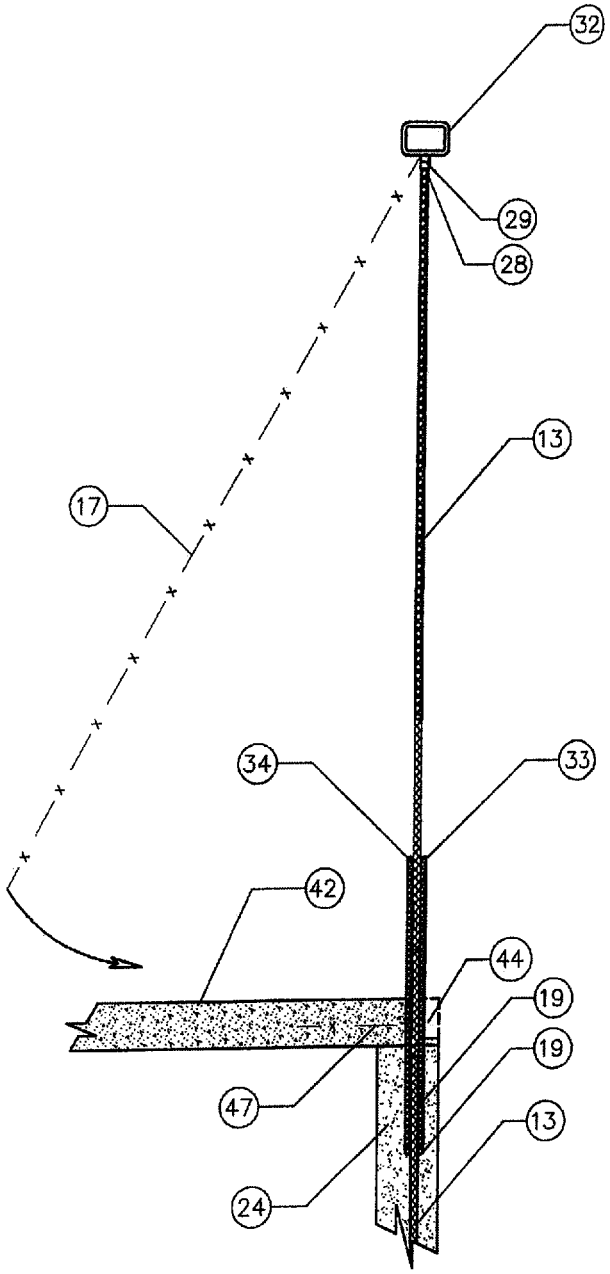
FIG. 18 is a cross-section depicting the placement of steel reinforcement between a lower wall, an intermediate floor slab, and the structural reinforcement in the wall above.

The top strand of a welded-wire fabric sheet 17 is lifted up so that it engages the several aligning tabs 18 located on the underside of the multi-story guiderail 32, FIGS. 10 and 18. The bottom edge or strand of the welded-wire fabric 17 is then slid horizontally until it is fully vertical and is wedged between the underside of the multi-story guiderail 32, and the top of the floor slab 10 upon which it is resting, FIGS. 11A and 27. The bottom edge of the welded-wire fabric 17 abuts firmly against the additional dowels 12 or welded-wire fabric 58, positioned along the wall, which extend vertically out of the floor slab 10. Please note that for clarity, the optional welded-wire fabric 58, if called for in a specific design, would be located in the same position as, and/or in addition to, the additional dowels 12, as shown on FIG. 2B. The additional dowels 12 or the welded-wire fabric 58, and the welded-wire fabric 17, are tied together using steel wire ties. The welded-wire fabric 17 is of sufficient strength and gauge so that it is self-supporting, and will stand in a vertical position when resting vertically on the slab and stabilized above from each side by the spaced apart aligning tabs 18 along the underside of the multi-story guiderail 32.

Figure 10A:
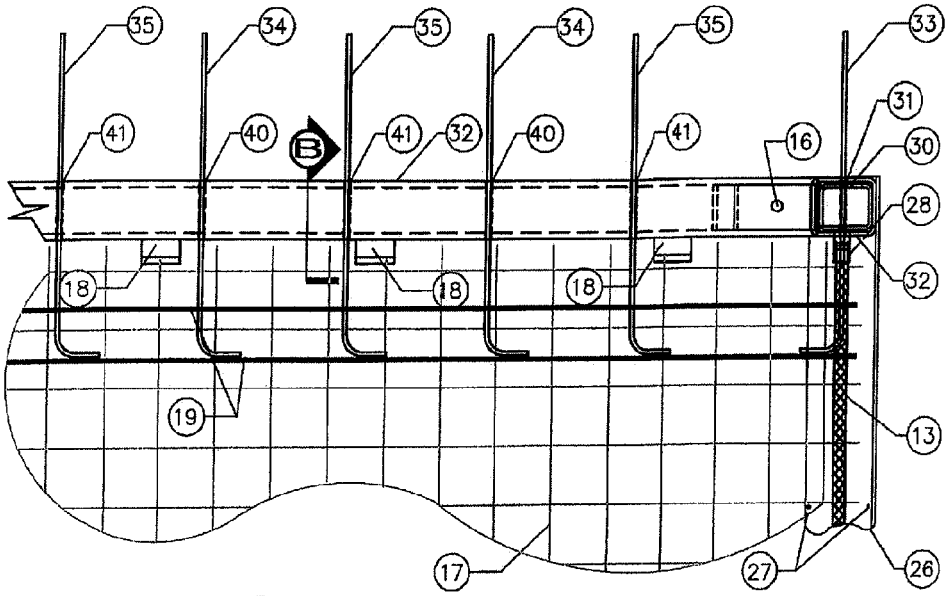
FIG. 10A is a composite diagram showing a guiderail connector attached to a guiderail and how the steel reinforcement is secured to the reinforcement in the lower wall.
Figure 12:
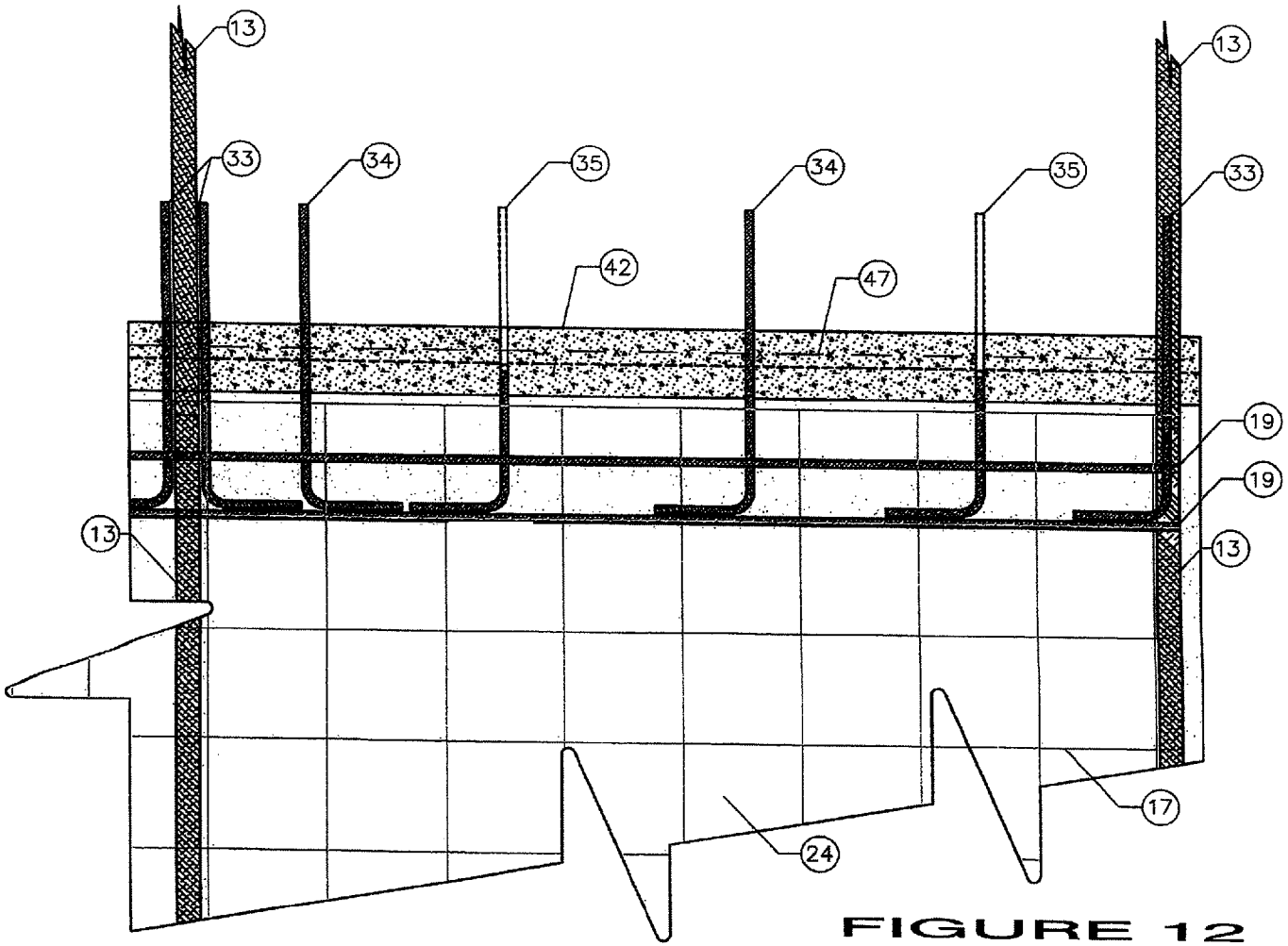
FIG. 12 is a side view section of a lower wall and its relationship to the floor slab above and structural components.
Figure 16A:
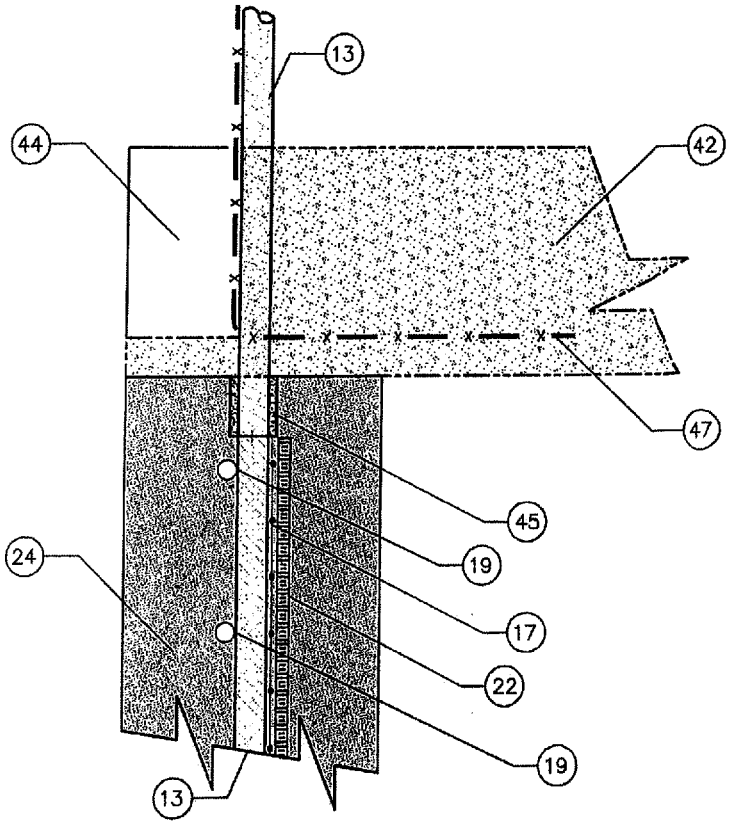
FIG. 16A is a cross-section showing the relationship between the lower wall and the floor slab above.
Figure 16B:
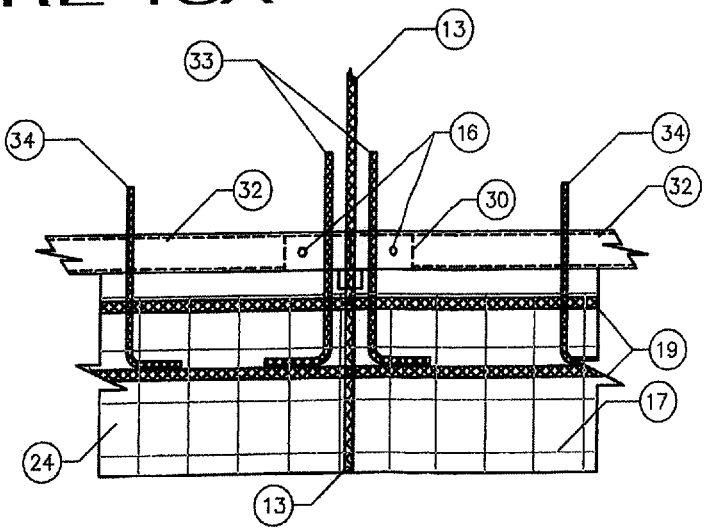
FIG. 16B is side-view section of a guiderail connector, guiderails, and the structural steel components that tie the lower wall to the floor slab and wall above.

One or two rows of reinforcing horizontal rebar 19 are attached to the outside surface of the welded-wire fabric 17 as shown in FIGS. 10A, 12 and 16B. The number of rows and size of horizontal reinforcing rebar 19 are determined by engineering requirements for a given structure. Assuming one row of horizontal reinforcing rebar 19 is used, it is attached to the outside surface of the welded-wire fabric 17 at the second strand from the top of the fabric sheet, approximately six inches below the underside surface of the multi-story guiderail 32. Note that the first strand of welded-wire fabric 17 is already wedged securely in the aligning tabs 18 in the multi-story guiderail 32 as described above. If two rows of reinforcing horizontal rebar 19 are required, the second row will be attached to the third strand from the top of the welded-wire fabric 17, approximately twelve inches below the multi-story guiderail 32. The horizontal reinforcing rebar 19 is tied to its corresponding, horizontal strand of welded-wire fabric 17, with steel wire ties.

Figures 11A, 11B:
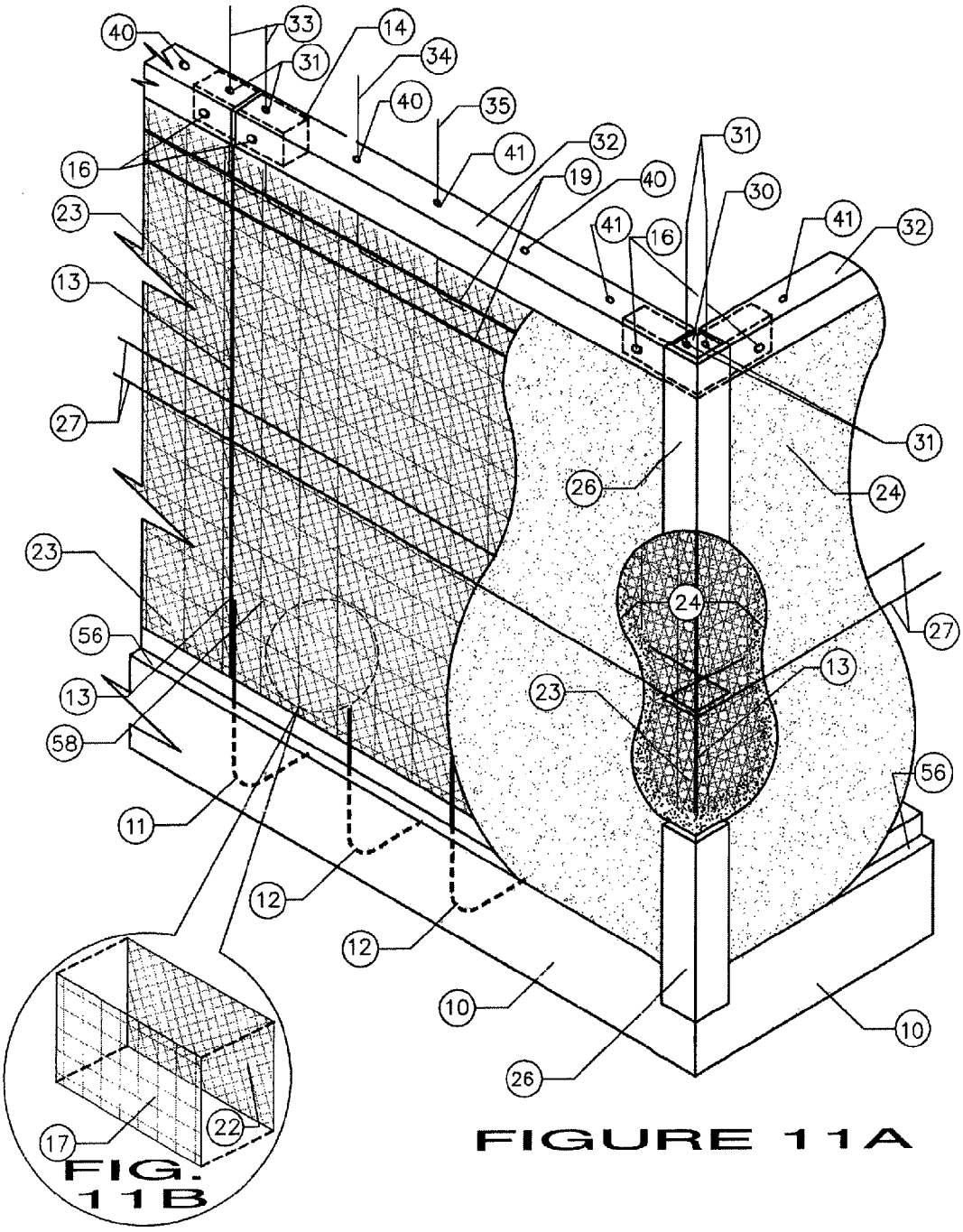
FIG. 11A is a three-dimensional diagram of two intersecting wall panes, showing the structural panel and its various components with the concrete applied.
FIG. 11B is an enlarged section of FIG. 11A.

Once the reinforcing horizontal rebar 19 is attached to the second and third strands of the welded-wire fabric 17, the steel rebar hook dowels 34 for the second-story walls 43 and the second-story concrete floor slab 42, as shown in FIGS. 10A, 11A and 12, is attached as follows:

Steel rebar hook dowels 33 of the appropriate gauge and length are placed up through the two guide holes 31 located in the multi-story guiderail connector 30, FIGS. 10A, 11A, 15 and 16B. The hook end of each steel rebar hook dowel 33 is tied to the lower row of reinforcing horizontal rebar 19, FIGS. 10A, 12, and 16B, which is attached to the third strand of welded-wire fabric 17.

Steel rebar hook dowels 34 and 35 of the appropriate gauge and length are then placed up through multiple guide holes, 40 and 41, respectively, of the multi-story guiderail connector 32, located approximately every twelve inches on center along the length of the multi-story guiderail 32, FIGS. 10A, 11A and 16B. The steel hook rebar dowels 34 are located approximately every 24 inches on center, and will be embedded in the second story wall above, FIGS. 10A, 11A, 14, 16B and 19. The steel rebar hook dowels 35 are located approximately every inches on alternate centers and will be bent over and imbedded in the second story concrete floor slab 42, FIGS. 10A, 11A, 12, 14 and 19.

The steel rebar hook dowels 33, 34, and 35 are tied to the lower row of reinforcing horizontal rebar 19 which is attached to the third strand of welded-wire fabric 17, as shown in FIGS. 10A, 11A, 12, and 16B.

Figures 17A, 17B:
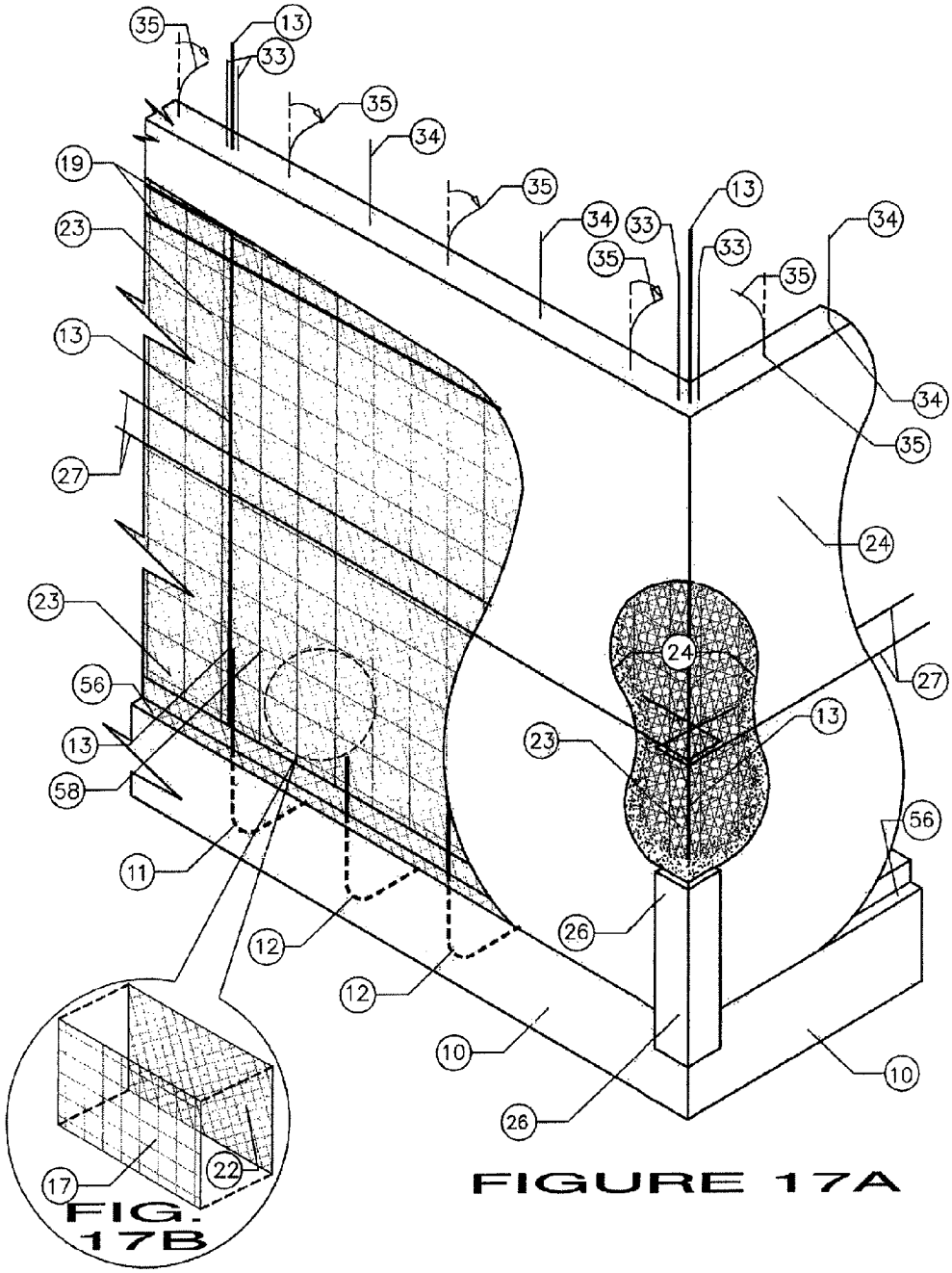
FIG. 17A is a three-dimensional diagram of two intersecting walls and their various components, with the shotcrete applied.
FIG. 17B is an enlarged section of FIG. 17A.

Sheets of rib lath 22, which is a form of expanded metal mesh, are applied to the inside surface of the welded-wire fabric 17, as shown in FIG. 11B, for the entire length of each section of a wall. The rib lath 22 is set on the surface of the floor slab 10 and runs vertically up to within approximately one-half of an inch from the underside of the multi-story guiderail 32. The rib lath panels 22 are secured to the welded-wire fabric 17 with steel wire ties periodically at various intervals, as shown in FIG. 1. The combination of welded-wire fabric 17 and rib lath 22 comprises the structural panel 23 as shown in FIGS. 11B and 17B. The structural panel 23 comprises the surface to which concrete will be applied. Alternatively, the structural panel 23 can also contain one or more additional layers of welded-wire fabric attached to either side of the structural panel 23, depending on the strength requirements and dimensions proscribed for the given wall design of a particular structure.

If there are to be any openings in the wall, such as doors and windows, they must be accommodated for at this time. Once the structural panel 23 is in place, openings are cut of sufficient size to provide for the doors and windows in accordance with the given unit design. Door placeholders 50 and window placeholders 51 are placed into each opening, framing out the openings, as follows. The door placeholders 50 and window placeholders 51 can be made out of the same material as the multi-story guiderails 32, or they can be made out of aluminum, plastic or wood. If they are to be made out to the same material as the multi-story guiderail 32, the corners of the door placeholders 50 and window placeholders 51 are mitered on a 45-degree angle and welded so that there are no open seams. Placeholders for doors 50 and windows 51 are shown in FIG. 7. The outside dimensions for these placeholders 50 and 51 are provided by the respective manufacturer and are referred to as masonry openings. The placeholders for doors 50 and windows 51 have holes 52 placed in each vertical member as shown in FIG. 7. The door placeholders 50 are placed directly on the floor slab 10. They are held in place by inserting a locking pin 53 through each of the holes 52 located on the door placeholder 50. A locking pin receiving sleeve, 54 is slipped over the terminal end of each locking pin 53 once it is in place. Each locking pin receiving sleeve 54 is tied to the outside surface of the welded-wire fabric 17 using steel wire ties. This configuration positions the door placeholder 50 in the center of the wall, and holds it firmly in place during the later application of the shotcrete.

The window placeholders 51 are secured in the same manner as the door placeholders. They are held in place using two window placeholder hangers 55 that are hung over the multi-story guiderail 32 and are secured to both sides of the window placeholder 51 with metal screws at a predetermined height. Once the window placeholder 51 is held in position, four locking pins 53 are inserted through the holes 52 in the window placeholder 51. The locking pin receiving sleeves 54 are placed over the terminal end of the locking pins 53. The locking pin receiving sleeves 54 are then tied securely to the outside surface of the welded-wire fabric 17 with steel wire ties.

An alternate method of securing the window placeholders 51 in their proper position is to place the locking pins 53 through the holes 52, and place the locking pin receiving sleeves 54 over the terminal end of the locking pins 53. The window placeholder is then held in place while the locking pin receiving sleeves 54 are tied to the outside surface of the welded-wire fabric 17 using steel wire ties. Utilizing this method, the two window placeholder hangers 55 would not be required. Either of these two methods of attaching the door and window placeholders, 50 and 51, respectively, can be utilized no matter what material is used for the construction of the window and door placeholders. In the event additional or other openings are required in a wall panel for air conditioning units, vents, and other unit construction features that may be called for in a given unit design, the same style of placeholders will be fabricated and used with the same assembly process utilized for the window and door placeholders.

A corner gauge bracket 26, which is an "L" shaped device the width of the wall running in each direction, is placed at each corner of the wall panel, as shown in FIGS. 1, 5, and 8. The corner gauge bracket 26 is attached to each corner of the structure by capturing the outside corner of the floor slab 10, at the bottom, and extends up to capture the outside corner of the multi-story guiderail connector 30. The corner gauge bracket 26 serves two important functions. First, it defines the exact edge of the corner of the exterior of two intersecting walls as the structure is subsequently being sprayed with shotcrete. This provides a precise corner without any excess waste of concrete. Second, when applied to the external corner of the structure, the corner gauge bracket defines the precise width of the wall. With the gauge brackets in place, strands of Gunite wire or piano wire, hereinafter collectively referred to as gauge locators 27, are looped around the outside of the gauge brackets 26, located at opposite ends of the wall, and tightened as shown in FIG. 1. Depending on the height of the wall, as few as one or as many as three vertically-spaced gauge locators 27 can be placed along the height of the corner gauge bracket to secure it in position.

Shotcrete is now sprayed on both sides of the structural panels 23 throughout the structure. Excess shotcrete is screeded or shaved off flat, using the gauge locators 27, the edge of the multi-story guiderail 32, and the outside surface of the floor slab 10, as guides for the screeding and surface-leveling process, throughout the structure. Once the concrete has had sufficient time to cure, the gauge locators 27, the locking pins 16, the corner gauge brackets 26, the guiderails 32, and the guiderail connectors 30 are all removed, and may then be reused on the next structure, or are retained and used for the next floor above, if applicable. The locking pins 53 for the door 50 and window 51 placeholders are removed. The door and window placeholders 50 and 51 are removed as well. The remaining structure, once cured, consists of a solid, level, concrete-and-steel wall frame describing the entire structure.

The foregoing process results in a solid, level, concrete-and-steel lower wall, with standard rebar hook dowels 33, 34, and 35 embedded in the wall and extending vertically out of the top of the wall, FIGS. 12 and 17A. These will be tied into the concrete floor and the concrete wall to be constructed above, as follows:

The construction methodology for the second-story wall will be demonstrated by describing the assembly of one second-story wall section between two vertical supports. This upper-level wall section could represent the wall between two corners of a structure or a representative section in a longer, straight wall.

After the multi-story guiderail connector 30 is removed from the cured lower wall, two pieces of reinforcing rebar hook dowels 33 are protruding out of the top of the wall at each end of the wall section.

Figure 13:
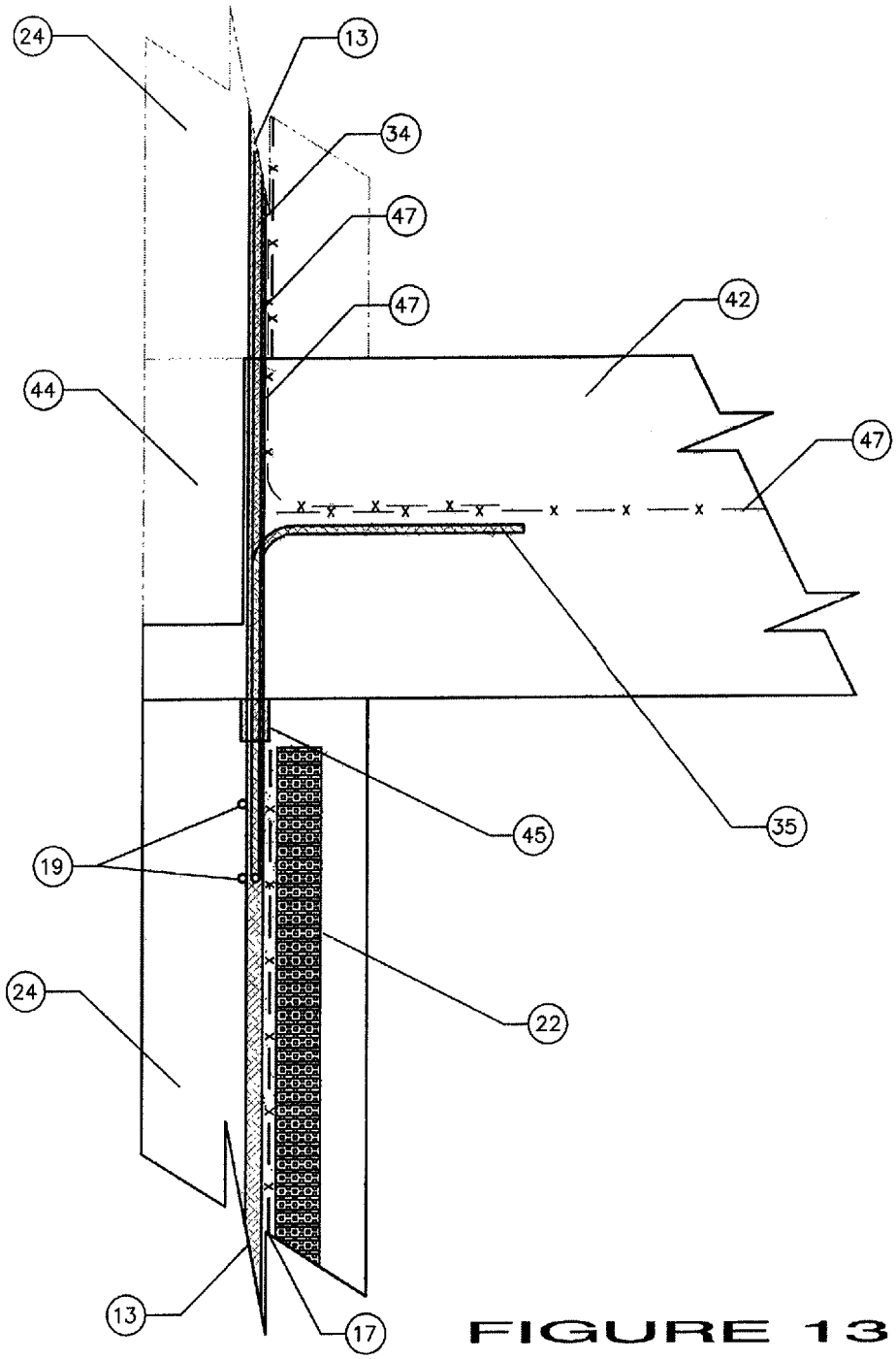
FIG. 13 is a cross-section of a lower wall and its relationship to the upper floor slab.

When the multi-story guiderail connector 30 is removed, it leaves a circular depression 45 in the top of the wall created by the receiving sleeve 28 and the receiving sleeve plug 29, FIGS. 13 and 16A.

A length of vertical support rebar 13 is placed into the circular depression 45, and is tied to the two pieces of steel rebar hook dowel 33 with steel wire ties, FIGS. 12, 16B, and 17A. The length of the vertical support rebar 13 will define the height of the second-story wall. All of the vertical support rebar 13 for the multi-story guiderail connectors 30, whether they are corner guiderail connectors, intersecting guiderail connectors, or continuation guiderail connectors, are all similarly secured for the entire structure prior to forming the second-story concrete floor slab 42.

The second-story concrete floor slab 42 is formed by using conventional methods and materials. It is temporarily supported by engineered shoring, or permanently supported by using steel floor joists. The steel reinforcing requirements for the concrete floor slab will depend on thickness of the slab and the span between supporting walls. Additional form boards are added to the upper, inside surface of the exterior forms for the second-story concrete floor slab 42. This will provide notch 44 after the forms are stripped off, FIGS. 13, 14, 16A and 19. Additionally, the rebar hook dowel 35 is bent over into the second-story concrete floor slab 42, and is attached to the reinforcing steel 47 for the second-story concrete floor slab 42, FIGS. 12, 13, 14 and 19.

Lastly, an additional piece of welded-wire fabric 47, approximately three feet long, is bent in the middle at a right angle, and the bend is attached to the lower inside surface of the form board prior to pouring the second-story concrete floor slab 42. After the second-story concrete floor slab 42 is poured, you will have half of the welded-wire fabric 47 embedded in the second-story concrete floor slab 42, and the other half will extend vertically out of the second-story concrete floor slab 42 at the inside edge of the notch 44, FIGS. 13 and 16A. The protruding upper portion of the welded-wire fabric 17 will ultimately be imbedded in the upper wall at the notch 44, FIG. 13. The notch 44 serves two purposes. First, it provides for the placement of additional steel reinforcement to tie the upper-story wall 43 to the second-story concrete floor slab 42. Second, it provides a water stop for the upper-story floor, to keep water from coming through the upper-story wall 43.

After the second-story concrete floor slab 42 has been poured and cured, the second-story walls 43 are constructed as follows:

We commence the construction of the second-story walls with a flat, hard surface consisting of the second-story concrete floor slab 42, and the notch 44 provided for in the outer edge of the second-story concrete floor slab 42, FIGS. 13, 14, 16A and 19. Along the inside edge of the notch 44, welded-wire fabric 47 extends vertically approximately 1.5 feet. There are vertical supports 13 tied to two steel rebar hook dowels 33 at each end of the wall section, FIGS. 12, 13, 16B and 17A. Along the length of the wall, steel rebar hooks 34 are stubbed out of the floor slab 42 just inside of the notch 44 at specified intervals according to the given unit design specifics.

Figure 15:
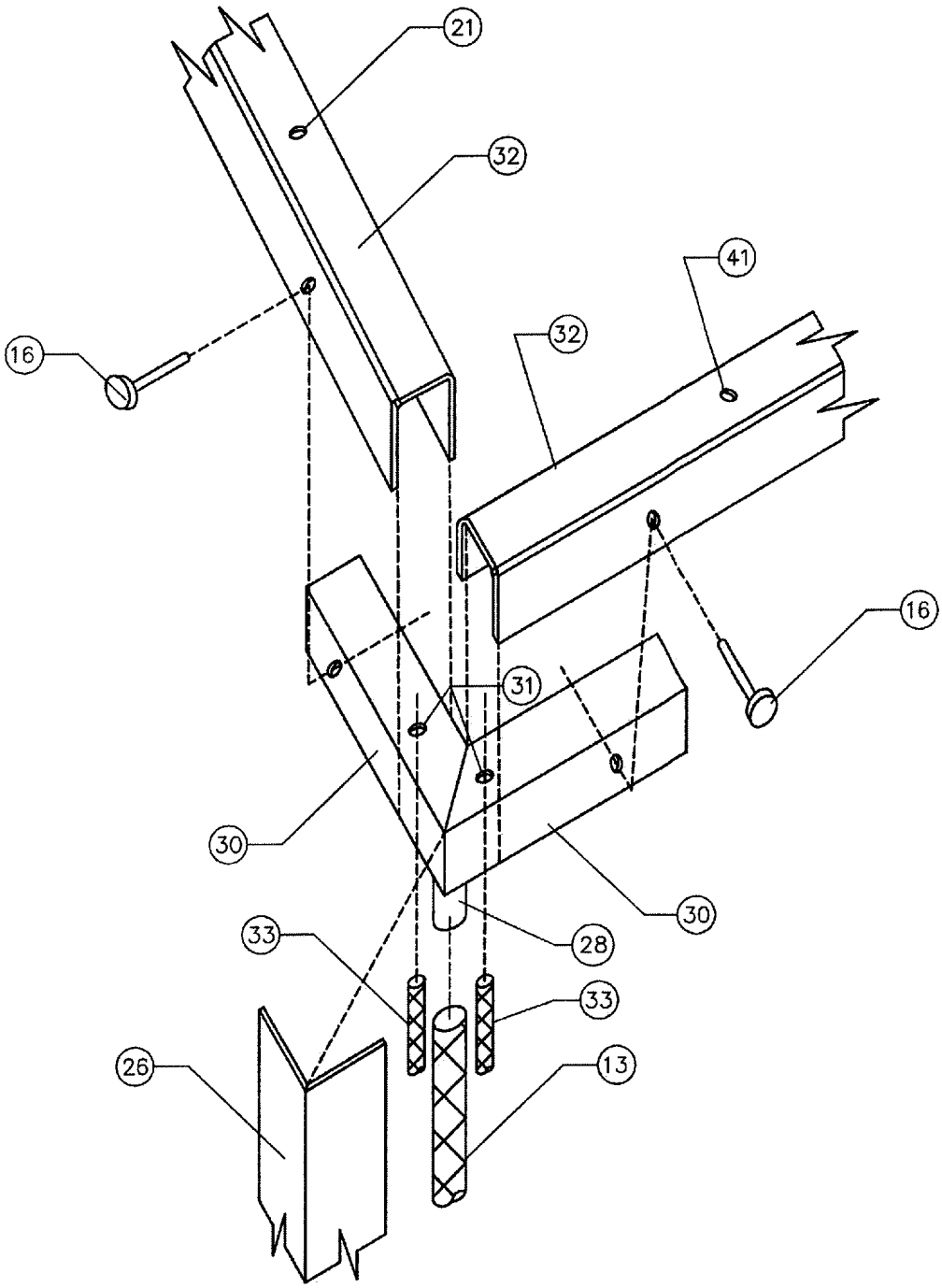
FIG. 15 is an exploded diagram of a multi-story guiderail connector and its relationship to a multi-story guiderail.

Multi-story guiderail connectors 30 are then placed on top of the vertical support rebar 13 by placing the upper end of the vertical support rebar into the receiving sleeve 28, FIGS. 10A and 15. The multi-story guiderail 32 is placed over the multi-story guiderail connectors 30 and secured with locking pins 16, FIGS. 10A, 11A and 15.

Figure 10B:
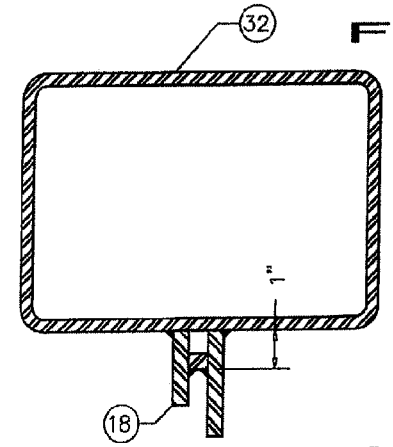
FIG. 10B is a cross-section of a guiderail and its associated locking device.
Figure 10C:
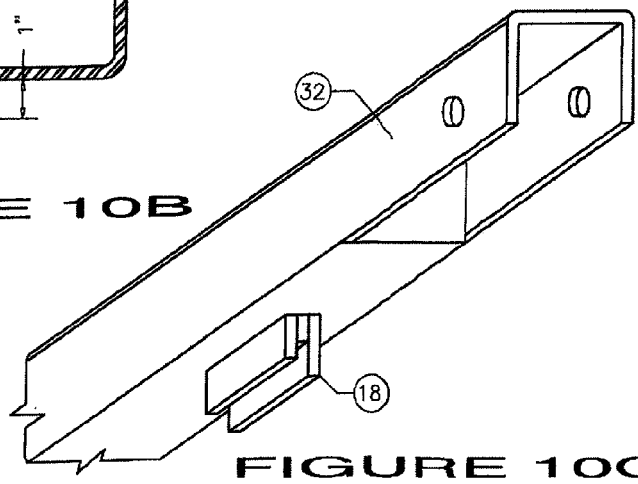
FIG. 10C is a three-dimensional diagram showing a guiderail and its associated locking device.

The top strand of welded-wire fabric 17 is lifted up so that it engages the aligning tabs 18 located on the underside of the multi-story guiderail 32, FIGS. 10A, 10B and 10C. The bottom edge or strand of the welded-wire fabric 17 is then slid sideways until it is firmly wedged between the underside of the multi-story guiderail 32 and the top surface of the second-story concrete floor slab 42, FIG. 18. There it will abut the steel rebar hooks 34 that extend vertically out of the second-story concrete floor slab 42, FIG. 18. The welded-wire fabric 17 and the steel rebar dowels 34 are tied together using steel wire ties. The welded-wire fabric 17 is of sufficient strength and gauge so that it is self-supporting, and will stand in a vertical position when stabilized by the multi-story guiderail 32.

One or two rows of horizontal reinforcing rebar 19 are attached to the outside surface of the welded-wire fabric 17 as shown in FIGS. 10A, 11A and 16. The number of rows and size of horizontal reinforcing rebar 19 are determined by engineering requirements for a given structure. Assuming one row of horizontal reinforcing rebar 19 is used, it is attached to the outside surface of the welded-wire fabric 17 at the second strand from the top of the fabric sheet, approximately six inches below the underside surface of the multi-story guiderail 32. Note that the first strand of welded-wire fabric 17 is already wedged securely in the aligning tabs 18 in the multi-story guiderail 32 as described above. If two rows of reinforcing horizontal rebar 19 are required, the second row will be attached to the third strand from the top of the welded-wire fabric 17, approximately twelve inches below the multi-story guiderail 32. The reinforcing horizontal rebar 19 is tied to its corresponding, horizontal strand of welded-wire fabric 17, with steel wire ties.

Figure 14:
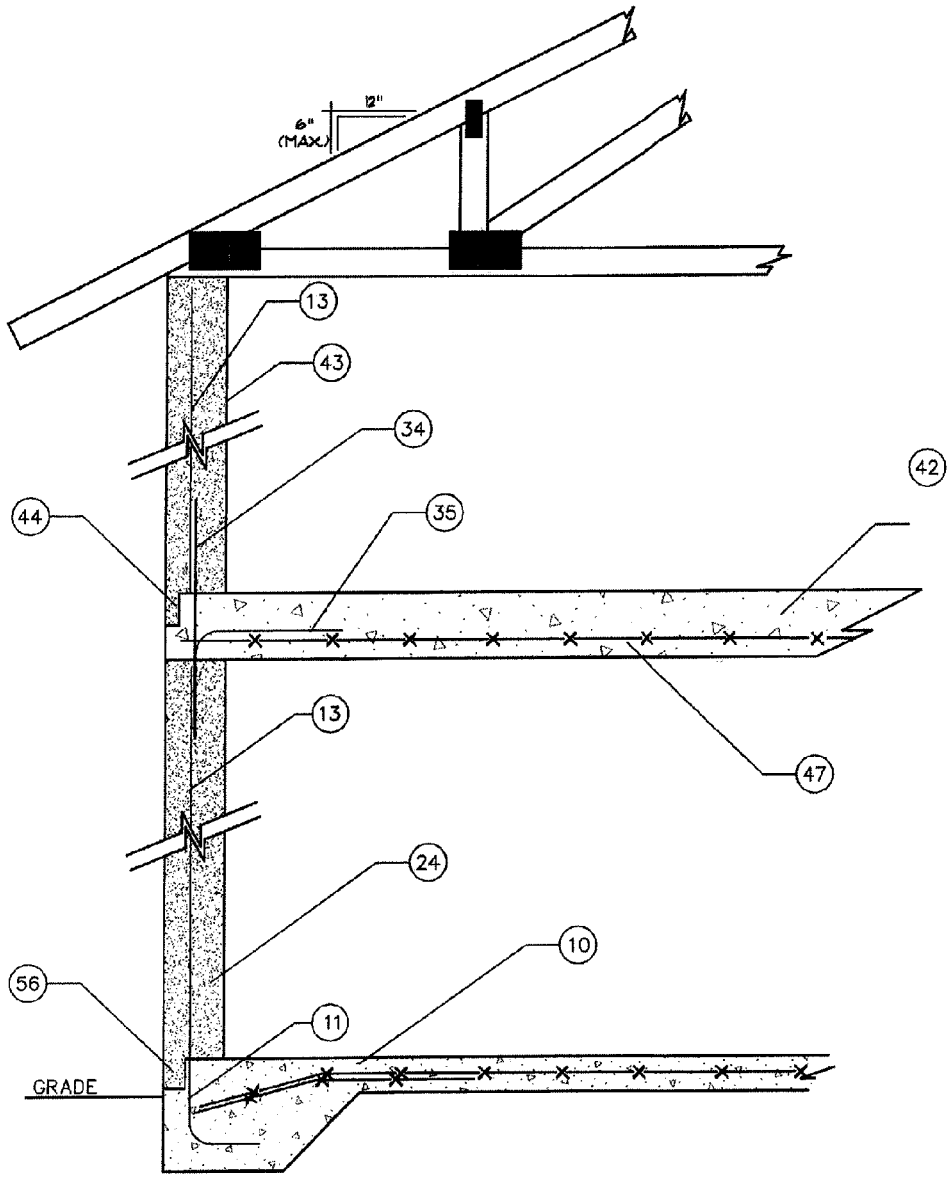
FIG. 14 is a cross-section of a two-story structure with an intermediate concrete floor slab and a truss roofing system on the top floor.

To the extent a given unit design specifies a roof system utilizing trusses, FIG. 14, roof truss anchors 20 are placed up through linear slots 21 that are present throughout the guiderail 15, FIGS. 1, 6, and 8. The linear slots 21 pre-cut into the guiderail are positioned at intervals along the guiderail 15 in accordance with the engineered roof truss design for the given structure, and are perpendicular to the external vertical surface of the guiderail 15, except for the slots for the hip trusses in the corners, which slots are cut at a 45-degree angle to the external vertical surface of the guiderail 15, as shown in FIGS. 1, 6, and 8. Once the roof truss anchor 20 is placed up through the linear slot 21, an optional locking pin 57 can be placed through one of the holes in the roof truss anchor 20 at a point above the guiderail 15 to temporarily secure it during the construction process, as shown in FIG. 1. The roof truss anchors 20 may alternately be secured by tying them to one of the rows of reinforcing horizontal rebar 19 that is attached to the welded-wire fabric 17, and/or directly to the welded-wire fabric 17, with steel wire ties. The bottom of each roof truss anchor 20 is positioned approximately six to twelve inches below the top of the wall, depending upon design requirements, so that the lower portion of it that is extending below the guiderail will ultimately be imbedded and surrounded by concrete. The roof truss anchors 20 do not support any portion of the structural panel 23 as shown in FIG. 1.

In the event a given unit design specifies a flat concrete roof rather than a roof system utilizing trusses, standard rebar hook dowels 36 are utilized rather than truss anchors, FIGS. 19 and 20. The standard rebar hook dowels 36 are tied to the reinforcing horizontal rebar 19 utilizing steel wire ties, and protrude above top of the wall, FIG. 20. The number and placement of the rebar hook dowels 36 will be determined by engineering and design requirements.

Sheets of rib lath 22 are applied to the inside surface of the welded-wire fabric 17, as shown in FIG. 1A, for the entire length of each section of a wall. The rib lath 22 is set on the surface of the floor slab 10 and runs vertically up to within approximately one-half of an inch from the underside of the guiderail 15. The rib lath panels 22 are secured to the welded-wire fabric 17 with steel wire ties periodically at various intervals, as shown in FIG. 1B. The combination of welded-wire fabric 17 and rib lath 22 comprises the structural panel 23 as shown in FIGS. 1B and 7. The structural panel 23 comprises the surface to which concrete will be applied. Alternatively, the structural panel 23 can also contain one or more additional layers of welded-wire fabric attached to either side of the structural panel 23, depending on the strength requirements and dimensions proscribed for the given wall design of a particular structure.

If there are to be any openings in the wall, such as doors and windows, they must be accommodated for at this time. Once the structural panel 23 is in place, openings are cut of sufficient size to provide for the doors and windows in accordance with the given unit design. Door placeholders 50 and window placeholders 51 are placed into each opening, framing out the openings, as follows. The door placeholders 50 and window placeholders 51 can be made out of the same material as the guiderails 15, or they can be made out of aluminum, plastic or wood. If they are to be made out to the same material as the guiderail 15, the corners of the door placeholders 50 and window placeholders 51 are mitered on a 45-degree angle and welded so that there are no open seams. Placeholders for doors 50 and windows 51 are shown in FIG. 7. The outside dimensions for these door placeholders 50 and window placeholders 51 are provided by the respective manufacturer and are referred to as masonry openings. The placeholders for doors 50 and windows 51 have holes 52 placed in each vertical member as shown in FIG. 7. The door placeholders 50 are placed directly on the floor slab 10. They are held in place by inserting a locking pin 53 through each of the holes 52 located on the door placeholder 50. A locking pin receiving sleeve 54 is slipped over the terminal end of each locking pin 53 once it is in place. Each locking pin receiving sleeve 54 is tied to the outside surface of the welded-wire fabric 17 using steel wire ties. This configuration positions the door placeholder 50 in the center of the wall, and holds it firmly in place during the later application of the shotcrete.

The window placeholders 51 are secured in the same manner as the door placeholders. They are held in place using two window placeholder hangers 55 that are hung over the guiderail 15 and are secured to both sides of the window placeholder 51 with metal screws at a predetermined height. Once the window placeholder 51 is held in position, locking pins 53 are inserted through the holes 52 in the window placeholder 51. The locking pin receiving sleeves 54 are placed over the terminal end of the locking pins 53. The locking pin receiving sleeves 54 are then tied securely to the outside surface of the welded-wire fabric 17 with steel wire ties.

An alternate method of securing the window placeholders 51 in their proper position is to place the locking pins 53 through the holes 52, and place the locking pin receiving sleeves 54 over the terminal end of the locking pins 53. The window placeholder is then held in place while the locking pin receiving sleeves 54 are tied to the outside surface of the welded-wire fabric 17 using steel wire ties. Utilizing this method, the two window placeholder hangers 55 would not be required. Either of these two methods of attaching the door and window placeholders, 50 and 51, respectively, can be utilized no matter what material is used for the construction of the window and door placeholders. In the event additional or other openings are required in a wall panel for air conditioning units, vents, and other unit construction features that may be called for in a given unit design, the same style of placeholders will be fabricated and used with the same assembly process utilized for the door placeholders 50 and window placeholders 51.

A corner gauge bracket 26, which is an "L" shaped device the width of the wall running in each direction, is placed at each corner of the wall panel, as shown in FIGS. 1, 5, and 8. The corner gauge bracket 26 is attached to each corner of the structure by capturing the outside corner of the floor slab 10, at the bottom, and extends up to capture the outside corner of the guiderail connector 14. The corner gauge bracket 26 serves two important functions. First, it defines the exact edge of the corner of the exterior of two intersecting walls as the structure is subsequently being sprayed with shotcrete. This provides a precise corner without any excess waste of concrete. Second, when applied to the external corner of the structure, the corner gauge bracket defines the precise width of the wall. With the gauge brackets in place, strands of Gunite wire or piano wire, hereinafter collectively referred to as gauge locators 27, are looped around the outside of the gauge brackets 26, located at opposite ends of the wall, and tightened as shown in FIG. 1. Depending on the height of the wall, as few as one or as many as three vertically-spaced gauge locators 27 can be placed along the height of the corner gauge bracket to secure it in position.

Shotcrete is now sprayed on both sides of the structural panels 23 throughout the structure. Excess shotcrete is screeded or shaved off flat, using the gauge locators 27, the edge of the guiderail 15, and the outside surface of the floor slab 10, as guides for the screeding and surface-leveling process, throughout the structure. Once the concrete has had sufficient time to cure, the gauge locators 27, the locking pins 16, the corner gauge brackets 26, the guiderails 15, and the guiderail connectors 14 are all removed, and may then be reused on the next structure. The locking pins 53 for the door 50 and window 51 placeholders are removed. The door and window placeholders 50 and 51 are removed as well.

In applications where multiple additional floors are required, the process described above is repeated until the desired number of floors have been completed.

The remaining structure, once cured, consists of a solid, level, concrete-and-steel wall frame describing the entire structure. The roof truss anchors 20, FIG. 1A, for a specified truss-based roof, or alternatively the rebar hook dowels 36, FIG. 20, for a specified concrete flat roof, are embedded in and are extending above the top of the walls, ready to receive and connect to the roofing system.

The building system allows for the rapid, cost-effective construction of solid concrete-and-steel walls that are seamlessly integrated with the foundation and construction pad. The construction process incorporates stabilizing elements that hold a primary layer or sheet of welded-wire fabric in place. Expanded metal mesh, or rib lath, is attached to, and supported by, the primary layer of welded-wire fabric. Additional layers of welded-wire fabric can be added to either side of the primary layer depending on strength requirements for each specific construction application or project. The primary layer of welded-wire fabric is of sufficient gauge and strength to ensure that each of the wall framing sections are capable of standing vertically during the assembly process without the need for additional vertical support. The primary layer of welded-wire fabric rests on a flat substrate, or foundation. The foundation is prepared using steel rebar that has been strategically placed at specified intervals for support and reinforcement before the pad is poured. The foundation rebar dowels extend vertically out of the surface of the foundation at or close to the center of each wall section being constructed into the foundation. The rebar foundation steel dowels protruding from the foundation structure are attached to the lower portion of the primary layer of welded-wire fabric. Uniquely-designed, interlocking temporary upper guiderails for the welded-wire fabric, held in place by vertical rebar support rods, are placed at the top of each section of wall framing. The temporary guiderails are utilized to stabilize the top edge of the primary layer of welded-wire fabric during the concrete application process. The rib lath is then attached to the surface of the primary layer of welded-wire fabric. The welded-wire fabric and rib lath collectively form the basic "structural panel" of each wall section. Strength requirements for a given structure and the width of the wall may require additional layers of welded-wire fabric to be added to one or both sides of the basic structural panel. When fully assembled, the tightly-bound layers of welded-wire fabric and rib lath mesh forms a continuous, uninterrupted structural panel which constitutes the framing or shell of the structure. Pressurized concrete is then evenly applied to all of the inside and outside surfaces of the structural panels throughout the structure, first to one side of the structural panels and then to the opposite side of the panels. The rib lath is manufactured so that the series of perforations or slots in it are of such a size and shape that will allow sufficient concrete to penetrate, or flow partially through it, to the opposite side of the rib lath. This ensures that concrete from one side of the mesh flows through and adheres to the concrete applied on the opposite side of the rib lath mesh, and blends together during the curing process. Once the concrete has cured sufficiently, the upper stabilizing guide rails are removed. The resulting steel mesh and concrete external walls of the structure are seamless and can intersect in virtually any configuration. Each structure can also contain integrated internal walls of the same construction process and materials, in virtually any configuration.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A method of constructing a durable wall for multi-story construction comprising the steps of:

forming a floor slab having a plurality of imbedded dowels having upwardly extending portions;

securing vertical supports formed from a length of rebar having a proximal end positioned on the floor slab next to each dowel;

positioning guiderail connectors above said vertical supports, each said guiderail connector including a receiving sleeve for receipt of said distal end of said vertical supports;

attaching guiderails to said guiderail connectors, said guiderails including spaced apart aligning tabs located along an underside;

fitting an upper edge of a welded-wire fabric between said aligning tabs, with a lower edge of said welded-wire fabric resting upon said floor slap and abutting against said dowels, securing said welded-wire fabric to the vertical supports;

attaching at least one row of horizontally disposed rebar to an outside surface of the welded-wire fabric approximately six inches below said underside surface of said guiderail;

placing rebar hook dowels through guide holes placed in said guiderail, said hook dowels perpendicular to an external vertical surface of said guiderail;

securing rib lath panels to an inside surface of said welded-wire fabric, said rib lath resting on the surface of the floor slab and sized to extend from the underside of said guiderail to form a structural panel;

spraying shotcrete on both sides of said structural panel;

shaving excess shotcrete using gauge locators placed along an edge of said guiderail and the outside surface of the floor slab;

removing gauge locators, guiderails, and the guiderail connectors upon the curing of said shotcrete, forming a base durable wall;

securing multi-story vertical supports formed from a length of rebar having a proximal end positioned next to each rebar hook dowel;

positioning guiderail connectors above said vertical supports, each said guiderail connector including a receiving sleeve for receipt of said distal end of said multi-story vertical supports;

attaching guiderails to said guiderail connectors, said guiderails including spaced apart aligning tabs located along an underside;

fitting an upper edge of a welded-wire fabric between said aligning tabs, with a lower edge of said welded-wire fabric resting upon the top of the base durable wall and abutting against said rebar hook dowels, securing said welded-wire fabric to the multi-story vertical supports;

attaching at least one row of horizontally disposed rebar to an outside surface of the welded-wire fabric approximately six inches below said underside surface of said guiderail;

securing rib lath panels to an inside surface of said welded-wire fabric, said rib lath resting on the surface of the floor slab and sized to extend from the underside of said guiderail to form a multi-story structural panel;

spraying shotcrete on both sides of said structural panel;

shaving excess shotcrete using gauge locators placed along an edge of said guiderail;

removing gauge locators, guiderails, and the guiderail connectors upon the curing of said shotcrete, forming a first multi-story durable wall.

2. The method of constructing a durable wall according to claim 1 including the step of positioning said rebar hook dowels about 48 inches apart.

3. The method of constructing a durable wall according to claim 1 wherein said rebar hook dowels are formed from #4 or #5 rebar and extended upwardly above the base wall about 30 inches.

4. The method of constructing a durable wall according to claim 1 wherein said rebar hook dowels are placed along the corners of intersecting walls.

5. The method of constructing a durable wall according to claim 1 including the step of forming a 3.5-inch water stop recess into an outside edge of said multi-floor panel.

6. The method of constructing a durable wall according to claim 1 including the step of inserting a locking pin through the guiderail and into the guiderail connector to temporarily secure them together.

7. The method of constructing a durable wall according to claim 1 wherein said welded-wire fabric is of sufficient strength and gauge so that it is self-supporting and will stand in a vertical position and stabilized by said spaced apart aligning tabs located along the underside of the guiderail.

8. The method of constructing a durable wall according to claim 1 including the step of attaching a second horizontally disposed rebar to the welded-wire fabric approximately twelve inches below said guiderail.

9. The method of constructing a durable wall according to claim 1 including the installation of a locking pin into each roof truss anchor placed through said linear slots, said locking pin preventing said roof truss anchor from being drawn back through said linear slot.

10. The method of constructing a durable wall according to claim 1 wherein each guiderail connector includes a plug to position each vertical rebar support approximately 1 inch below the top surface of the proposed wall formation.

11. The method of constructing a durable wall according to claim 1 including the step of installing roof truss anchors at corners through a 45 degree slot located in corner brackets.

12. The method of constructing a durable wall according to claim 1 including the step of securing said roof truss anchors to at least one row of horizontally placed rebar.

13. The method of constructing a durable wall according to claim 1 including the step of securing said roof truss anchors to said welded-wire fabric.

14. The method of constructing a durable wall according to claim 1 including the step of adding one or more additional layers of welded-wire fabric attached to either side of the structural panel.

15. The method of constructing a durable wall according to claim 1 including the step of placing roof anchors through pre-cut linear slots present throughout said guiderail, said roof anchors perpendicular to an external vertical surface of said guiderail.

16. The method of constructing a durable wall according to claim 15 wherein said roof anchors are secured to roof truss.

17. The method of constructing a durable wall according to claim 15 wherein said roof anchors are secured to a flat roof.

18. The method of constructing a durable wall according to claim 1 including the step of:

securing an additional multi-story vertical supports formed from a length of rebar having a proximal end positioned next to each rebar hook dowel of said first multi-story durable wall;

positioning guiderail connectors above said vertical supports, each said guiderail connector including a receiving sleeve for receipt of said distal end of said multi-story vertical supports;

attaching guiderails to said guiderail connectors, said guiderails including spaced apart aligning tabs located along an underside;

fitting an upper edge of a welded-wire fabric between said aligning tabs, with a lower edge of said welded-wire fabric resting upon the top of the base durable wall and abutting against said rebar hook dowels, securing said welded-wire fabric to the multi-story vertical supports;

attaching at least one row of horizontally disposed rebar to an outside surface of the welded-wire fabric approximately six inches below said underside surface of said guiderail;

placing roof anchors through pre-cut linear slots present throughout said guiderail, said roof anchors perpendicular to an external vertical surface of said guiderail;

securing rib lath panels to an inside surface of said welded-wire fabric, said rib lath resting on the surface of the floor slab and sized to extend from the underside of said guiderail to form a multi-story structural panel;

spraying shotcrete on both sides of said structural panel;

shaving excess shotcrete using gauge locators placed along an edge of said guiderail;

removing gauge locators, guiderails, and the guiderail connectors upon the curing of said shotcrete, forming an additional multi-story durable wall.

* * * * *